United States Patent [19]

Del Principe et al.

[11] 4,372,557

[45] Feb. 8, 1983

[54] ELECTRONIC BASEBALL GAME

[75] Inventors: Robert M. Del Principe, Hawthorne; David A. Reichert, Carson, both of Calif.

[73] Assignee: Mattel, Inc., Hawthorne, Calif.

[21] Appl. No.: 222,094

[22] Filed: Jan. 2, 1981

[51] Int. Cl.[3] ..... A63F 9/00

[52] U.S. Cl. ..... 273/88; 273/85 G

[58] Field of Search ..... 273/88, 856, 93 R

[56] References Cited

U.S. PATENT DOCUMENTS

| | | | |
|---|---|---|---|
| 2,883,193 | 4/1959 | Iannone et al. | 273/88 |
| 3,655,189 | 4/1972 | Alexander, Jr. | 273/88 |
| 3,790,170 | 2/1974 | Alexander, Jr. | 273/88 |
| 4,195,838 | 4/1980 | Santandreau et al. | 273/88 |

OTHER PUBLICATIONS

Joseph J. Roehrig, "*The National Micro Pastime*", Nov. 79.

*Primary Examiner*—Vance Y. Hum
*Assistant Examiner*—Leo P. Picard
*Attorney, Agent, or Firm*—Reagin & King

[57] ABSTRACT

An electronic baseball game which includes a housing mounting a display centrally on an upper surface. On either side of the display are operator consoles for controlling a visiting team and a home team. At least one operator selects two lineups of players based on batting averages, throwing abilities, and the like. The operator controlling the team at bat selects when to hit by depressing keys which select different swings and controls runners in the attempt to reach and to steal bases. On defense, an operator controls the pitches thrown by the pitcher and the bases to which defensive fielders throw the ball in attempting to throw out the runners. An operator may also substitute in his batting order to obtain pinch hitters or relief pitchers. A special feature of the invention is that the results of each phase of the game depend on the characteristics of the players involved.

5 Claims, 29 Drawing Figures

14

FIG. 4V2
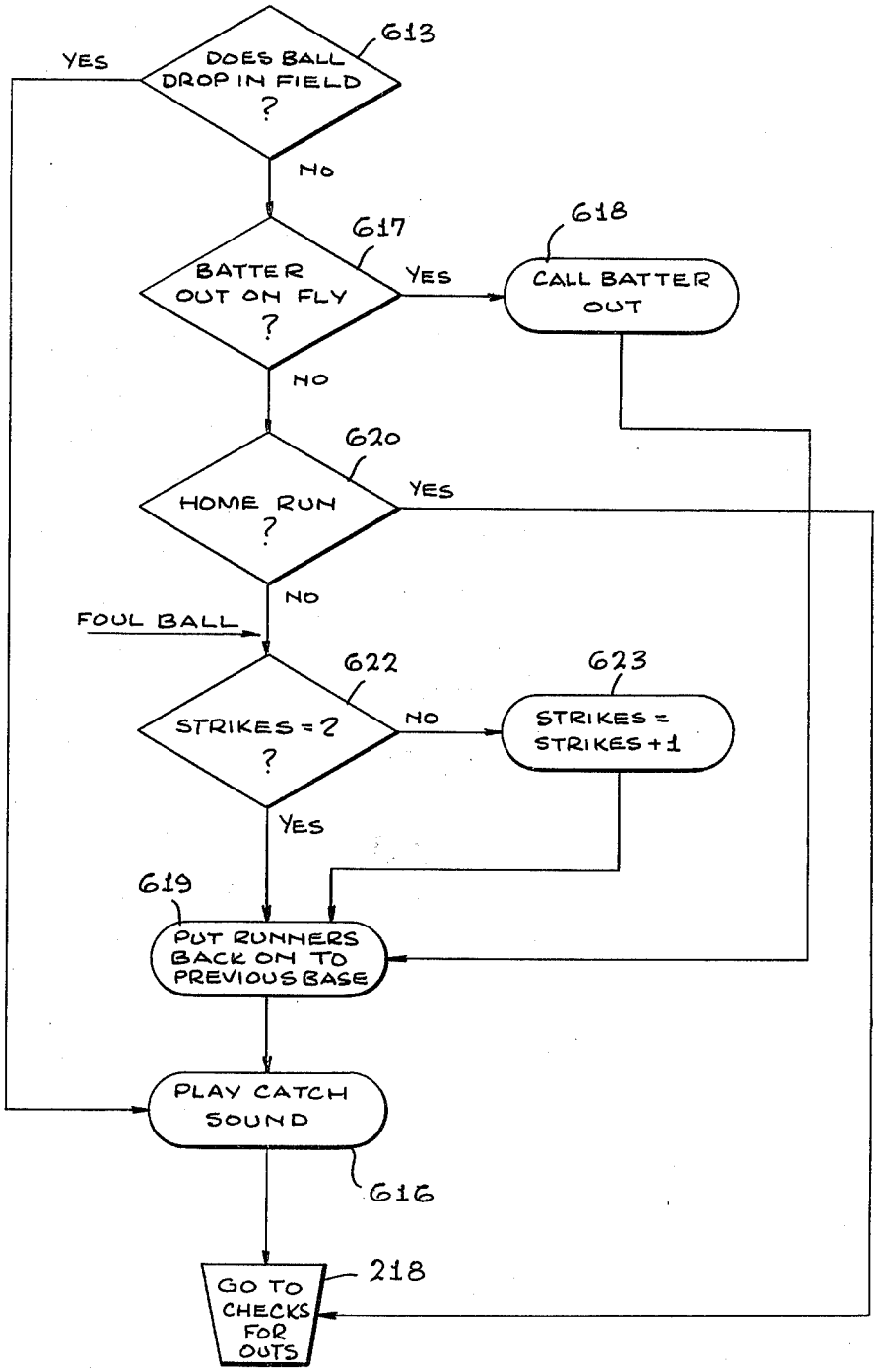

FIG. 4-W
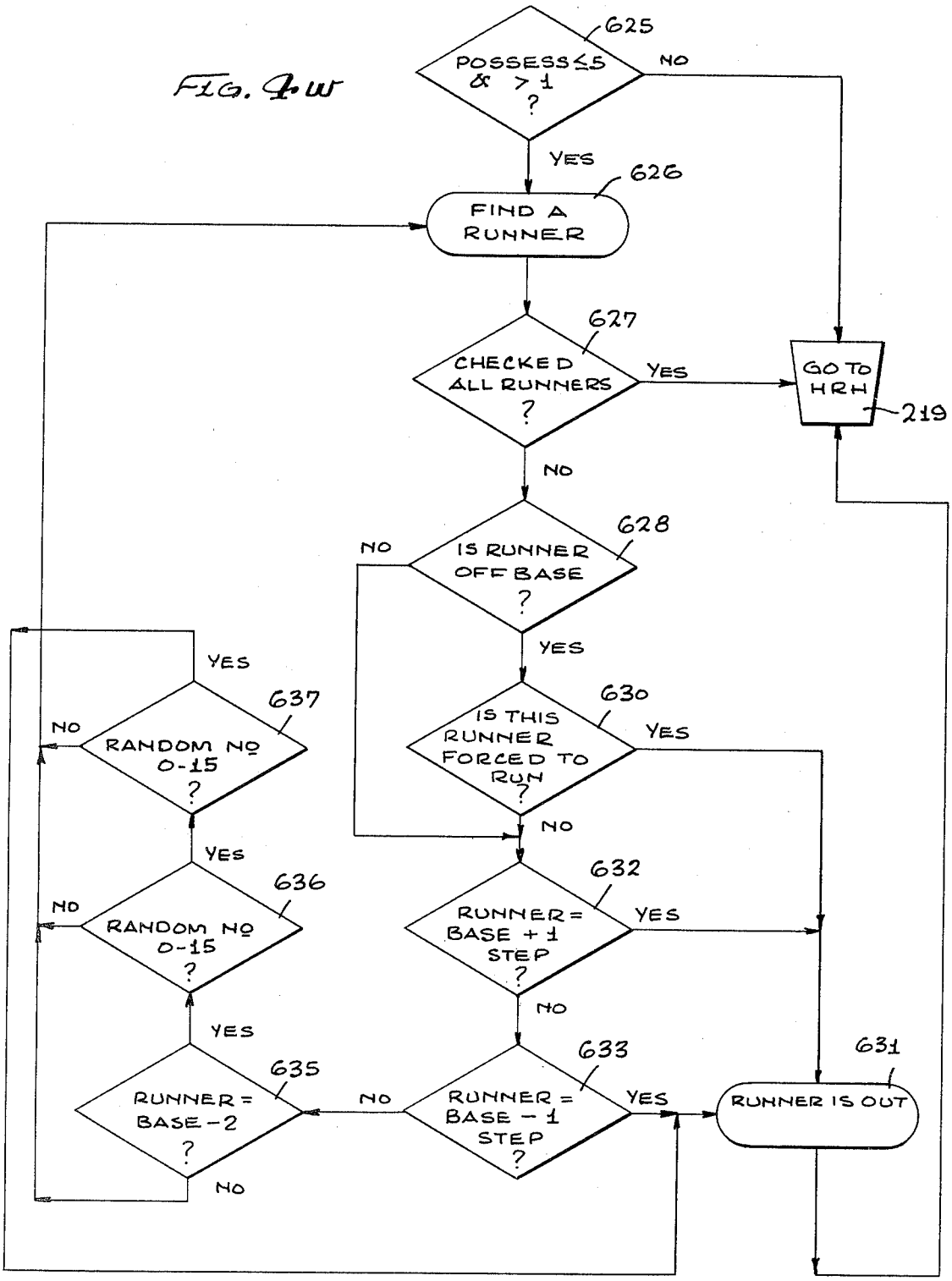

ELECTRONIC BASEBALL GAME

BACKGROUND OF THE INVENTION

This invention relates to games and, more particularly, to electronic games for simulating the play of athletic games.

People appear to have been involved in the playing of games since the beginning of recorded history. The almost universal interest in games seems to be due to the excitement engendered by competition and chance. Many competitive games require a large number of players, large fields, and a substantial amount of equipment.

Recently, various improvements in electronic circuitry have allowed the reduction in size and cost of data processing circuitry and have led to electronic circuits which may simulate the play of various players in certain well known games. In these electronic games, an operator moves an electronic player against electronic competitors thereby eliminating the necessity for some or all of the human players. Many of these electronic games are quite expensive and many must be connected to a television set to provide a display upon which the game may be presented.

Recently, a number of portable electronic games have been devised by which one or two persons may play a particular simulated sports game such as football, basketball, or baseball. These portable games have their own built-in displays and are much less expensive, in general, than those which must be connected to a television set. Their small size allows them to be carried about and used almost anywhere. However, these portable electronic games have relatively small displays, contain a limited amount of circuitry, and are usually powered by battery. Consequently, the portable electronic games heretofore devised have been relatively unsophisticated when contrasted to those which are associated with television sets.

For example, electronic baseball games are known in which certain actions of players may be simulated. Such games allow an operator to direct a pitcher to pitch a ball, a batter to bat a ball, and runners to traverse the bases under control of the control circuitry of the game. However, most such games only simulate an actual game of baseball in a very crude fashion.

It is, consequently, an object of this invention to provide a new and improved portable electronic baseball game.

It is another object of this invention to provide a new and improved electronic baseball game capable of play by one or two persons at a sophisticated level.

It is another object of this invention to provide an electronic baseball game operable at different levels of difficulty.

SUMMARY OF THE INVENTION

The foregoing and other objects of the invention are accomplished by an electronic baseball game which includes a housing mounting a display centrally on an upper surface. On either side of the display are key positions for an operator who controls the visiting team and an operator who controls the home team. In the game, one operator may play against a central control or two operators may play against each other. Each operator selects his own lineup of players based on batting averages, throwing abilities, and the like. The operator controlling the team at bat selects when to hit by depressing keys which select a bunt swing, a normal swing, or a home run swing. The operator of the team at bat also controls the runners in the attempts to reach base and to steal bases. On defense, each operator controls the pitches thrown by his pitcher and the bases to which defensive fielders throw the ball in attempting to throw out the runners. Each operator may also substitute in his batting order to obtain pinch hitters or relief pitchers. A special feature of the invention is that as a pitcher is hit more often he loses strength and becomes more susceptible to additional hits.

In a preferred embodiment, a microprocessor controls the display upon which the various players appear and keeps track of the balls and strikes, the outs in the inning, and the scores. The microprocessor also controls certain features of the game and assures that the rules of the game are followed by the players.

Other objects, features, and advantages of the invention will become apparent from the specification taken in conjunction with the drawings in which like elements are referred to by like reference designations throughout the several views.

DESCRIPTION OF THE PREFERRED EMBODIMENT

Figure 1:
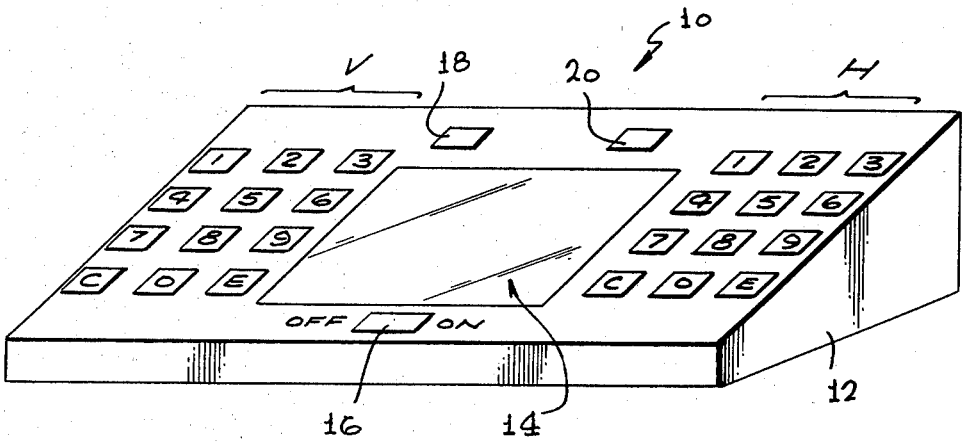
FIG. 1 is a perspective view of an electronic baseball game constructed in accordance with the invention.

Referring now to FIG. 1 there is shown a perspective view of a game 10 constructed in accordance with the invention. The game 10 shown in FIG. 1 includes a housing 12 which may be constructed in a preferred embodiment of one of the moldable plastic materials which are well known in the prior art. Although not shown in FIG. 1, means may be provided upon the lower surface of the housing 12 for inserting a battery for operating the control circuitry of the game 10.

On the upper surface of the housing 12 is mounted a display 14 which is more completely described with regard to FIG. 2 below. An off/on switch 16 is positioned below the display 14 on the upper surface of the housing 12, and a pair of switches 18 and 20 are positioned above the display 14 on the upper surface of the housing 12. Each of the switches 18 and 20 may, in the preferred embodiment, be a depressable button or key. The switch 18 is used to obtain the score of the game at any particular time while the switch 20 is used to obtain the inning being played at any particular time. Indications of the score and the inning appear on the display 14 in response to the depression of the switches 18 and 20 as will be explained below.

Positioned to the left of the display 14 on the upper surface of the housing 12 is a visitors' keyboard generally designated V which includes twelve keys designated V1-V9, VC, VO, and VE. To the right of the display 14 is positioned a home keyboard generally designated H which includes twelve keys similar to the visitor keys but designated H1-H9, HC, HO, and HE. These control keys are used by the operators controlling the visiting and home teams to select the players to be utilized in the lineup, to determine the positions of those players, to select and initiate pitches by the pitcher, to select and initiate swings by the batter, to cause runners to move along the base paths, and to cause throws from the fielders to other fielders in accordance with the play of the game. The visiting and home keyboards are also used by the operators to substitute players in the batting order and to replace a pitcher with a relief pitcher. In addition, various of the keys on the keyboards have multiple functions and are used in other manners as will be explained hereinafter.

Figure 2:
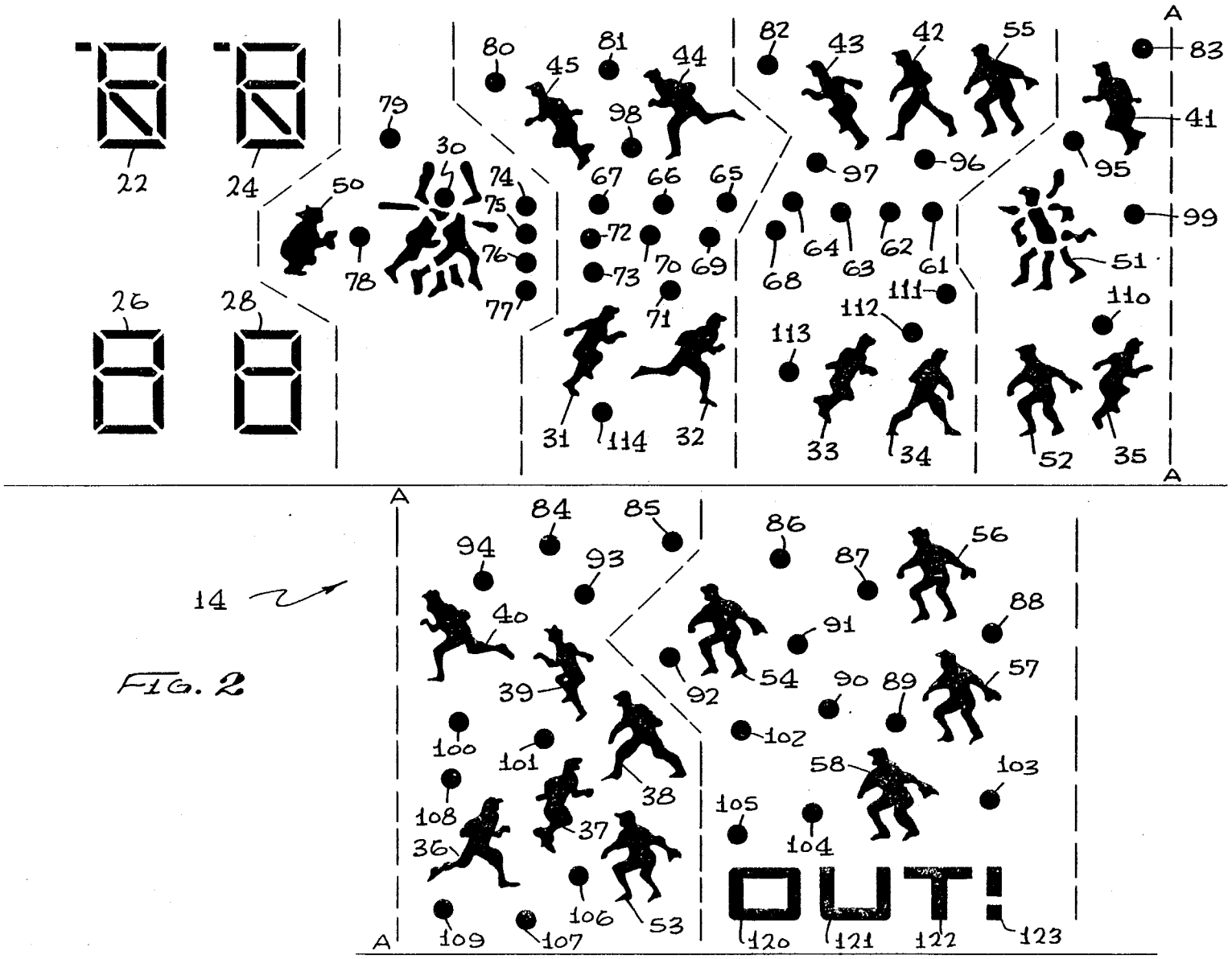
FIG. 2 is a detailed view of a display of the game shown in FIG. 1 which may be used in the game of this invention.

FIG. 2 is an enlarged view of the individual elements which may be shown on the display 14.

FIG. 2 has been divided into an upper and a lower portion for ease in constructing the drawing; the display 14, however, is a single display having the lower portion of FIG. 2 abutted at the dotted line A—A to the far left thereof to the dotted line A—A at the far right of the upper portion of FIG. 2. The display 14 shown in FIG. 2 may be constructed in a preferred embodiment of vacuum fluorescent components. Positioned in the upper left-hand corner of the display 14 are a pair of digit indicators 22 and 24 and in the lower left-hand corner of the display 14, directly below the digit indicators 22 and 24, are a second pair of digit indicators 26 and 28.

Positioned to the right of the digit indicators 22, 24, 26, and 28 are electrofluorescent display positions 30–45 which indicate in sequence the positions of the path taken by a base runner on his way around the base paths. The indicator shown at position 30 is a multi-element figure which has different portions illuminated in sequence to provide the steps of a batter swinging at a ball. The figure shown at position 34 illustrates a runner on first base; at position 38, a runner on second base; and at position 42, a runner on third base. Each of the players at positions 30–45 and the digit indicators 26 and 28 are in the preferred embodiment greenish-blue when lit.

Also shown, generally to the right of the digit indicators 22, 24, 26, and 28, are positions 50–58 which when lit illustrate respectively a catcher, a pitcher, a first baseman, a second baseman, a shortstop, a third baseman, a left fielder, a center fielder, and a right fielder. The positions 50–58 and the digit indicators 22 and 24 may, in a preferred embodiment, be red when lit. The position of the pitcher 51, like that of the batter 30, involves a substantial number of individual elements which when lit in a serial fashion cause the pitcher to appear to be moving through the wind-up and throwing the ball.

Also illustrated, to the right of the digits 22, 24, 26, and 28 on display 14, are a number of ball positions 61–114 which in the preferred embodiment may be yellow when lit. These ball positions 61–114 are utilized in order to provide a path illustrating ball travel during a pitch, a hit, a ground or fly out, or a throw from one fielder to another fielder.

Also illustrated on the display 14 in the lower right-hand corner are four digit indicators 120–123 which in the preferred embodiment are yellow when lit and form the word "OUT!"

By using three different colors on the display 14, the offensive and defensive teams may be clearly distinguished from one another and the path of the ball may be clearly seen. Furthermore, the home and visitors' scoring may be presented on the upper and lower digits respectively, thereby allowing easy understanding of the indications given.

As will be understood by those familiar with the game of baseball, with the catcher at the position 50, the pitcher at position 51, the first baseman at position 52, the second baseman at position 53, and so on, the view provided by the display 14 is from the first base side of the field and is perspective in nature. This allows the flight of the ball from the hand of the pitcher at position 51 to the hitter at position 30 to be clearly shown so that the operator of the team at bat may select a time in which to "hit" the ball. In the preferred embodiment, the ball positions 74 and 77 immediately to the right of the batter position 30 are positions in which a "ball" would be called were the batter not to swing at the pitch. On the other hand, the ball positions 75 and 76 are "strikes" whether or not the batter swings at the pitch.

It will be noted that there are three intermediate runner positions between each of the bases, e.g., the positions 35–37 between the runner position 34 at first base and the runner position 38 at second base. By lighting these particular positions in sequence, a runner will appear to run from first base to second base. Furthermore, as will be explained in detain hereinafter, a runner within one position of the base (immediately adjacent) is called out when the defensive man at that position receives the ball. This feature of the preferred embodiment of the game 10 allows steals to be included within the game as well as pickoff plays, rundowns, and the like.

Play of the Game

Play of the game 10 of this invention commences when the switch 16 is moved to the "on" position. When the switch 16 is moved to the "on" position, the game 10 is placed in the two-player mode of play; and the display 14 shows a "B" at digit indicator 22 and a "1" at digit indicator 24 signifying that it is time for the first man in the visitor's batting order to be selected by the operator. As pointed out above, the operator controlling the visiting team utilizes the keys designated V in the visitors' console to the left of the display 14 and the operator controlling the home team utilizes the keys designated H in the home console to the right of display 14. Both operators may use the switches 16, 18, and 20.

In order to select a batting order, an operator chooses from a list such as that shown in Table I in which (in the preferred embodiment) fifteen different players are shown sequentially by roster number:

TABLE I

| ROSTER # | POSITION | RBI | HR | AVG. | ARM STRENGTH | STOLEN BASES | BATS | THROWS | WL | ERA | SO |
|---|---|---|---|---|---|---|---|---|---|---|---|
| 1 | SS | 29 | 4 | .302 | Very Good | 90 | R | R | | | |
| 2 | Sub | 102 | 8 | .330 | Poor | 8 | L | R | | | |
| 3 | LF | 61 | 33 | .270 | Good | 20 | L | L | | | |
| 4 | 2B | 57 | 12 | .255 | Fair | 55 | R | R | | | |
| 5 | Sub | 33 | 14 | .192 | Good | 12 | R | R | | | |
| 6 | C | 84 | 16 | .302 | Good | 22 | R | R | | | |
| 7 | Sub | 53 | 20 | .307 | Fair | 49 | R | R | | | |

TABLE I-continued

| ROSTER # | POSITION | RBI | HR | AVG. | ARM STRENGTH | STOLEN BASES | BATS | THROWS | WL | ERA | SO |
|---|---|---|---|---|---|---|---|---|---|---|---|
| 8 | CF | 25 | 7 | .293 | Very Good | 13 | R | L | | | |
| 9 | RF | 98 | 39 | .202 | Poor | 3 | L | L | | | |
| 10 | 1B | 55 | 19 | .241 | Poor | 18 | L | L | | | |
| 11 | 3B | 91 | 36 | .313 | Very Good | 24 | R | R | | | |
| 12 | P | 6 | 0 | .060 | Very Good | 0 | L | L | 18-9 | 3.20 | 161 |
| 13 | P | 2 | 0 | .073 | Very Good | 0 | R | R | 8-5 | 3.73 | 47 |
| 14 | P | 5 | 1 | .121 | Fair | 1 | R | R | 20-12 | 3.27 | 144 |
| 15 | P | 4 | 0 | .092 | Good | 0 | L | L | 9-7 | 3.81 | 33 |

As may be seen from Table I, for each player is given, in addition to his roster number, a position indication, a total of runs batted in, a total of home runs, a batting average, an arm strength, a total of stolen bases, the side from which he bats (right or left), and the arm with which he throws. If the player is listed as a pitcher, Table I also indicates his won-lost record, his earned-run average, and the number of strike outs he has recorded. In the preferred embodiment, each of the visiting and home teams is assumed to have identical rosters.

The operator of each team selects a batting order by picking nine men from the roster and placing them in the order he desires. Having picked his batting order, the operator controlling the visiting team enters that batting order by entering each player in order by roster number and position. This is done with each player by first pressing the roster number of the player on the keyboard. Since the roster of the visiting team is entered first in the preferred embodiment, the operator controlling the visitors depresses the keys V1 and V2 to select the man indicated as roster number 12 in Table I. This causes the digit-indicators 26 and 28 to show "12". The operator then depresses the key VE to enter this batter in the batting order. At this point, the digit indicators 22 and 24 display "PN" indicating that the position number of the player is to be entered. This is accomplished by depressing keys for a number indicating the position the player is to play with each of the players being assigned those position numbers normal to baseball as follows (e.g., for the visitors): pitcher-V1, catcher-V2, first baseman-V3, second baseman-V4, third baseman-V5, shortstop-V6, left fielder-V7, center fielder-V8, and right fielder-V9. Thus, having selected the player with roster number 12 at a place in the batting order, to cause the player to be the pitcher, the operator controlling the visiting team depresses first the key V1 to indicate the position and then the key VE to cause the position to be entered.

Once the first batter has been entered, the display 14 shows in display digit indicators 22 and 24 an indication "B2" signifying that the second batter in the roster is to be selected. Each batter and his playing position is entered in order until all nine batters in the batting order have been entered. At this point, the control circuitry of the game 10 causes the digit indicators 22 and 24 to show "LV" signifying that selection of the speed of play is to be made. There are four speeds of play, each faster than the last. To select a speed of play, the operator of the visitors' team depresses one of the keys V1–V4, key V1 signifying the slowest speed. The speed selected is shown by the digit indicators 26 and 28. The operator then depresses the key VE to enter the selected speed. It should be noted that the speed of play controls the speed at which the ball is thrown from the pitcher to the catcher of the team at field and is selected by each operator in a two player game. Consequently, each operator may play at a different speed in order to equalize play between beginners and experts.

Once the visiting team lineup and speed of play have been entered, the digit indicators 22 and 24 again display "B1" indicating that it is time for the home team operator to select, as did the visiting team operator, a lineup from the player list of Table I and a playing speed. Once this has been accomplished, the two operators are ready to play the game 10.

In selecting a batting order, an operator may, in the preferred embodiment, make decisions at various levels of sophistication. For example, Table I shows that each player has a batting average and this batting average may be utilized in attempting to determine how often that player will hit when he swings at a pitch. On the other hand, the number of home runs helps indicate how often a player will hit a home run when he swings for the fences as will be explained hereinafter. Moreover, a player's arm strength may be utilized in determining the speed at which a ball travels from that player to another fielder and may be taken into account in determining which player to place in a particular position at field. In addition, the number of stolen bases is an indicator of the speed of the ball player on the base paths and should be considered by the operator in selecting a roster of players.

An additional consideration of an operator in selecting a roster is that statistically a batter's average is higher if the batter is batting from one side (right handed) while the pitcher throws from the other side (left). The control circuitry of the game of this invention provides for an increased hitting percentage where the batter swings from the side opposite that from which the pitcher throws.

In a like manner, the pitcher's characteristics are utilized in determining whether a pitcher should be allowed to pitch an entire game or should be utilized as a relief pitcher. A feature of the game is that each pitcher is assigned a pitching strength based on his pitching statistics and as opposing batters come in contact with a pitch (whether for a hit or an out), the pitching strength is reduced. Once a pitcher's strength is reduced to a particular level, the batters of the opposing team are able, in general, to obtain a statistically greater number of hits than before that point is reached.

Another feature of the game allows either operator to select an entire batting order by simply depressing the key VE or HE (depending on his console) when the indication "B1" is shown by digit indicators 22 and 24 of display 14 as that operator is about to enter his batting order. Depression of the enter key E automatically enters a lineup consisting of nine players of identical characteristics which in the preferred embodiment equal those shown as roster number seven in Table I. Thus, the operator depressing the enter key E instead of individually entering his players in his batting order obtains nine players for the nine positions all having batting averages of 0.307, fair arm strength, forty-nine stolen bases, and so on. This particular feature allows a tyro to play the game without an extensive understanding of the meaning of the statistics shown in Table I.

After the rosters and speeds have been entered by each operator, it is time to play the game; and the pitcher at position 51 begins to blink. It should be noted that in the preferred embodiment of the invention, any defensive player who holds the ball blinks. Initially, the home team is on defense, and the visitors' team is at bat. Consequently, the operator of the home team selects on the right-hand console the pitch to be thrown and initiates the pitch.

The operator controlling the pitcher may pick either a curve or a straight ball and may throw each at either a slow, a normal, or a fast speed. The slow pitch speed is selected by depressing the C key on the console controlling the pitcher. The fast speed is obtained by depressing the E key on the console controlling the pitcher. The normal speed is obtained when neither the slow nor the fast speed is selected. A curve ball is thrown if the zero key on the console controlling the pitcher is depressed while the failure to depress the zero key results in a straight ball being thrown.

Consequently, the pitcher may be made to throw a straight normal speed ball by depressing none of the C, O, or E keys and simply depressing the pitch key which in the preferred embodiment is key "5" on the console controlling the pitcher. On the other hand, by depressing keys "C" and "H" and then depressing the "5" key, the operator of the console may cause the pitcher to throw a slow curve.

Based on a selection process to be explained hereinafter, when the pitch key "5" is depressed, the elements of the pitcher at position 51 are lit in a manner to simulate a pitcher throwing the ball, and then ball positions are lit in serial order to define a path for the ball to the batter at position 30. Either a ball or a strike may be thrown based on this selection process. In the preferred embodiment, a straight "ball" passes serially through the ball positions labeled 61, 62, 63, 64, 65, 66, 67, 74 and ends at position 78 if not hit by the batter in position 30. A straight strike passes through ball positions 61, 62, 63, 68, 69, 70, 72, and 75 and ends in position 78 if not hit by the batter. A curve "ball" passes through ball positions 61, 62, 63, 64, 65, 70, 73, and 77 and ends at position 78 if not hit by the batter; and a curve strike passes through positions 61, 62, 63, 64, 65, 66, 72 and 76 and ends in position 78 if not hit by the batter.

It should be noted that, as explained above, three speeds of pitches may be thrown by depressing the various keys on the console controlling the pitcher. In addition, the speed of play which is keyed into the game 10 with the batting order controls the overall speed of pitching to that batting order, so that the three speeds of pitches appear at four different speed levels giving twelve total speeds of pitches. With four possible types of pitches which may be thrown (curve ball, curve strike, straight ball, straight strike), forty-eight distinct pitches may be thrown by the pitcher.

The batter at position 30 may swing at the pitch or let the ball pass and receive a strike or a ball indication depending on the results of his action. Presuming that the ball reaches the catcher at position 50, the figure at that position blinks indicating the catcher has the ball. To return the ball to the pitcher, the operator of the team at field presses the key "5" indicating the pitcher's position; and the ball is returned to the position 51 which begins to blink when the ball is received.

It should be noted that when the game is underway, the positions of the infielders including the catcher and pitcher are designated on the console of the team at field by a diamond configuration including the keys "2, 4, 6, 8" and key "5" surrounded thereby. In the preferred embodiment, a throw to the catcher is made by depressing key "4"; to the first baseman, by depressing key "8"; to the second baseman, by depressing key "6", to the third baseman by depressing key "2"; and to the pitcher, by depressing key "5". This enables an operator to react quickly in fielding a ball.

When the ball has been returned to the pitcher, the operator of the keyboard for the team at field then selects another pitch and depresses the key "5" causing the pitcher to throw the pitch to the batter at position 30. Again, the result of this pitch if not hit (a strike or a ball) is recorded and displayed on display 14 by the digit indicators 22 and 24. Presuming that the ball reaches the catcher at position 50, he may return the ball to the pitcher at position 51 in the same manner by depressing the key "5" on the console controlling the pitcher to indicate the pitcher's position. The catcher may also throw the ball to a base to catch a runner stealing. For example, the catcher at position 50 may throw the ball to the third baseman by depressing the key "2" if a runner is attempting to steal third base.

If the ball reaches the third baseman at position 55 before the runner reaches the third base position 42, the runner is usually automatically called out. As explained above, if the runner is within one position of the base when the fielder receives the ball, he is automatically out. Thus, if the runner is still at position 41 when the third baseman at position 55 receives the ball, the runner is called out. In like manner, if a base runner has taken a lead off first base and the catcher throws to first base in response to the home operator depressing the key H3 so that the first baseman at position 52 receives the ball (as indicated by a blinking position 52) while the runner is at position 35 adjacent the base, the runner is automatically called out. If the runner is in a position midway between bases, however, some time usually elapses before he is called out so that he may go back or ahead to an open base.

The operator controlling the batter at position 30 may cause the batter to bunt by depressing the key C on his console, to swing normally be depressing the key "0" on his console, and to swing for a home run by depressing the key E on his console. If the operator causes the batter to swing at a pitch which is either a strike, or a ball, at the correct time, the ball is hit. A ball hit by the batter is a foul, a ground out, a fly out, or a hit. The selection of the result depends on a procedure based on the pitcher's average and the hitter's average, among other things, as will be explained hereinafter. By depressing the key "0" , a batter obtains the highest percentage of hits, while by depressing the key "E", a lower percentage of hits but more home runs are obtained.

A ground ball to either the infield or the outfield follows a path defined by the various ball positions which are lighted in sequence. A fly ball, on the other hand, leaves the batter position 30 along an upward path, disappears from view, and then reappears on the field having taken a path which goes out of the top of the display 14. If a fly ball is caught by a fielder, that fielder immediately begins to blink and an out is shown on display 14 by the indicators at positions 120, 121, 122, and 123.

If a ball is hit on the ground (or is a fly ball which drops before being caught), there is a short time interval after the ball reaches its last position before the nearest fielder begins to blink to show that he has recovered the ball. Once the player begins to blink, the operator of the team at field may cause that player to throw the ball to a selected base by depressing the key indicating that base. For example, a throw to first base by the home team is accomplished by depressing the key H8. If the ball arrives at first base before the batter who is moving through positions 31, 32, and 33, the batter is called out. In like manner, a fielder, for example the left fielder at position 56, may throw the ball to second base by depressing key H6. When the second baseman at position 53 receives the ball he begins to blink.

As each out is made, it is indicated by the letters "OUT?" at the positions 120-123 and the total is displayed by the digit 26. Either operator may determine the number of outs at any time by reviewing these digits as an out occurs. An operator may also determine the score and the inning by depressing the keys 18 and 20 at any time other than during play. The inning key may also be used by the operator of the team at bat in order to determine the roster number of the player at bat. By depressing the key 20, the number is caused to appear on the display 14.

In addition to a hit or an out, a batter may hit a foul ball which is caught by the catcher at position 50. A foul ball counts as a strike in the preferred embodiment of the game.

When a batter receives four balls, he walks to first base. The player position 34 then stays lit to indicate that a runner is occupying first base. Any runners on the base paths ahead of a runner who walks are moved automatically to the next base. When the batter hits the ball, the runner automatically runs to first base. Runners on base are controlled by the keys "4" and "6" of the offensive console. The key "4" causes the runners to run backwards while the key "6" causes the runners to run forward. When the run forward key "6" is depressed, the lead runner on base leaves the base and proceeds toward the next base. He continues until the key "6" is released and then stops in position. By depressing the key "4", this runner may then be caused to move back to the base he just left.

If there are two runners on base when the key "6" is depressed, the lead runner commences running forward at his programmed speed followed by the next runner at his programmed speed. Consequently, a double steal is possible in the game. The nonlead runner, however, will not advance to an occupied base.

As explained before, if the ball reaches the base while the runner is in a position immediately adjacent but not on the base, the runner is called out. In the preferred embodiment of the game, if the ball reaches a fielder at a base while the runner is in the middle position between bases, a random delay occurs before the runner is called out so that the runner may run back to the base he has just left in an attempt to evade the tag. For example, if the third baseman at position 55 begins to blink while a runner is at position 40, the operator may release the key "6" and depress the key "4" causing the runner to run back toward second base. If he reaches second base before the ball reaches the fielder at that position, the runner is safe. Thus, the game includes steals and run down plays quite similar to those in an actual game of baseball.

It is possible that a lead runner will reach a base while a runner following is not yet on base and may still be thrown out. The operator may cause the trailing runner to run back to the base he has left by depressing the run back key "4". Only the trailing runner goes back since once the lead runner has reached a base he cannot go back.

If a runner is at position 40 when the fielder at position 55 begins to blink and does not move back rapidly enough in response to the depression of key "4" controlling his runback, he will be out after a short interval of time as though he had been tagged in a rundown.

When a runner leaves third base and crosses home plate, a run is automatically scored for the offensive team, is shown on the display, and is entered in the control circuitry memory. Each team plays until three outs occur in the inning at which time the other team is called up to bat and plays for three outs. In the preferred embodiment, the game has nine innings with no overtimes.

There will be situations in which it is desirable to replace a light hitting batter with one having a better batting average or capable of hitting more home runs. This is accomplished by the operator of the team at bat depressing the key "3" when the batter to be replaced comes to bat and then keying in the roster number of a player not previously in the batting order. When the key E is depressed, the new batter's roster number appears on the display 14 replacing that of the prior batter. Any man on the team may be replaced in this manner until all six of the substitutes have been used. Once a player has been replaced, he may no longer be used during that game.

In like manner, a pitcher may be replaced by the operator who controls the team at field. The operator simply depresses key "1" on his console, enters the roster number of the new pitcher, and depresses the key "E" to enter the new pitcher. This replacement is especially desirable once a pitcher has been "hit" sufficiently so that his arm strength has decreased to the point where the offensive team is receiving a substantially higher percentage of hits than when the pitcher was first used.

To select the one player mode of the game, the operator depresses the key "V1" on the visitors' keyboard while moving the switch 16 to the "on" position. This causes the digit indicators 22 and 24 to display "B1" signifying to the operator that he is to choose his lineup. The operator may choose a lineup using the visitor's console and cause that lineup to be entered in the normal manner or may depress the VE key to enter the standard lineup in which all players are identical to player number seven in the roster. After entering his lineup, the operator enters the speed of play for the visitors. The operator then, using the home keyboard, enters a defensive lineup and the home speed of play all as explained above. When this is complete, the pitcher at position 51 begins to blink indicating the pitcher has the ball and is ready to pitch.

In the one player mode, the operator plays offense only, and the control circuitry of the game plays defense only. The operator depresses the key "V1" to cause the ball to be pitched, and the control circuitry of the game 10 selects at random a pitch to be thrown. If the operator does not cause the batter at position 30 to swing at the ball or the batter at position 30 misses the ball, the catcher at position 50 receives the ball and automatically returns it to the pitcher for the next pitch. If the ball is hit and is caught by a fielder, the fielder blinks and the out indication on display 14 lights. If a ball hit by the batter is not caught on the fly by a fielder, a delay occurs before the nearest fielder begins to blink; and the control circuitry automatically causes the fielder to throw the ball to the pitcher at position 51. If a batter has not reached base when the pitcher receives the ball from a fielder, the batter and any other runner off base is out.

In the single player mode, three outs are played in an inning, and the game lasts for nine innings. Other than as above explained, the game and scoring are similar in the one and two player modes.

It should be noted that for ease of manipulation, the upper surface of the housing 12 in the preferred embodiment of the game is marked with indicators showing the functions of the various keys thereon. This is especially important in a fast-paced game like baseball where various of the keys are used for a number of different functions.

In the preferred embodiment, play of the game is accompanied by a number of sounds emitted by a speaker controlled by the control circuitry of the game 10. These sounds have been selected in order to enhance the play of the game by adding emphasis to the occurrences on the field thereby adding excitement to play. The game sounds are as follows:

TABLE II

| GAME SOUNDS | |
|---|---|
| PUNCHING IN NUMBERS | different patterns of high-pitched beeps |
| PRESS ENTER KEY | single low-pitched tone. |
| "THROW" TO A BASE | single high-pitched beep. |
| CAUGHT BALL | single low-pitched beep. |
| STRIKE | high tone |
| BALL | lower tone |
| HITS | high pitched tone, simulates "crack" of the bat |
| OUTS | three short buzzer tones |
| INNING'S OVER | long sustained buzzer tone |
| INNING'S OVER, RUN SCORED | up and down riff, plus sustained buzzer tone. |
| HOME RUN | tune of high pitched tones |

In the preferred embodiment, the digits 22, 24, 26, and 28 are used to provide scoring for the game. The digit 22 shows the number of balls a batter has accumulated, the digit 24 shows the number of strikes, and the digit 26 the total number of outs the team at bat has accumulated. Runs for each team are shown by all of the digits as explained above.

Figure 3:
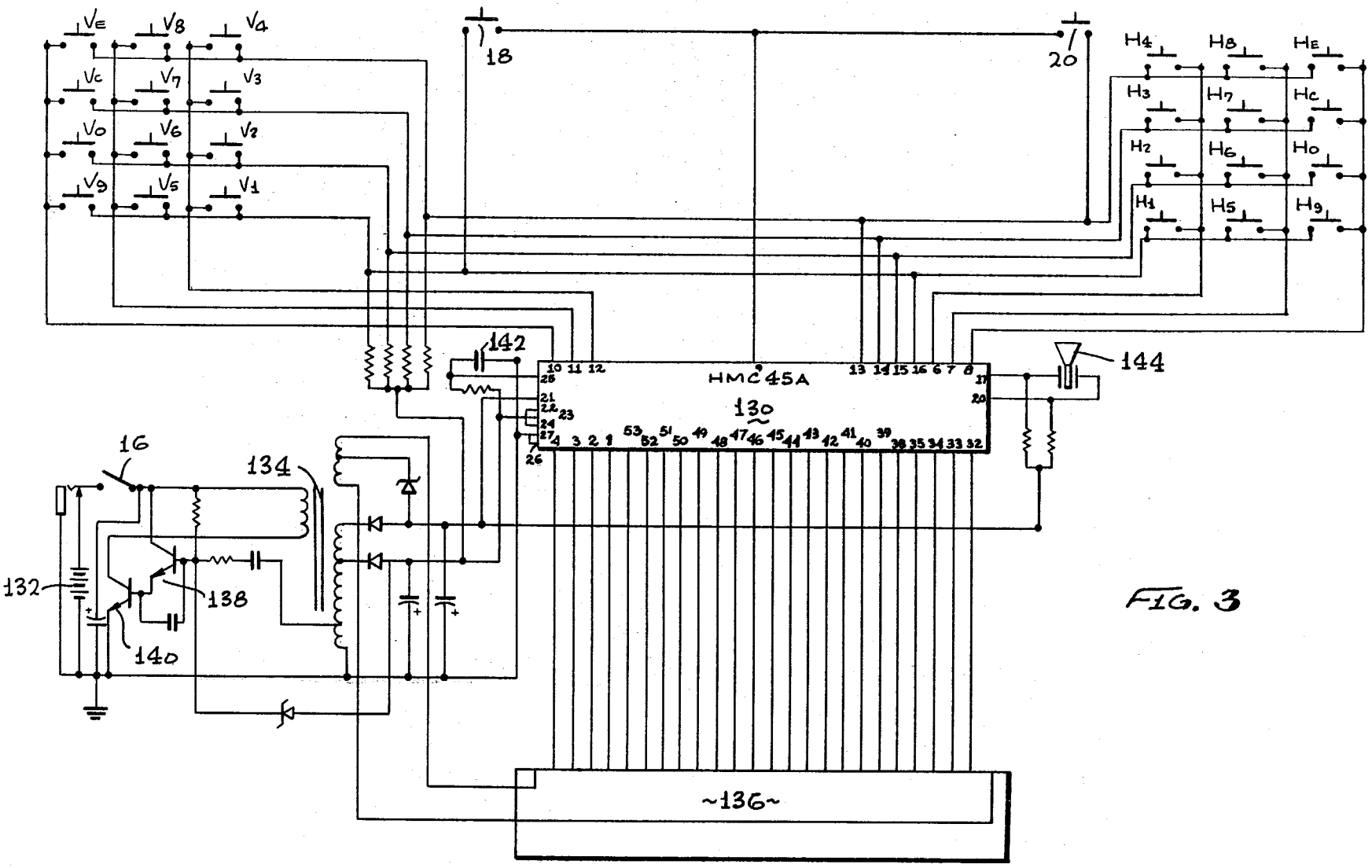
FIG. 3 is a schematic/block diagram illustrating the circuitry of the game of this invention.
Figure 4A:
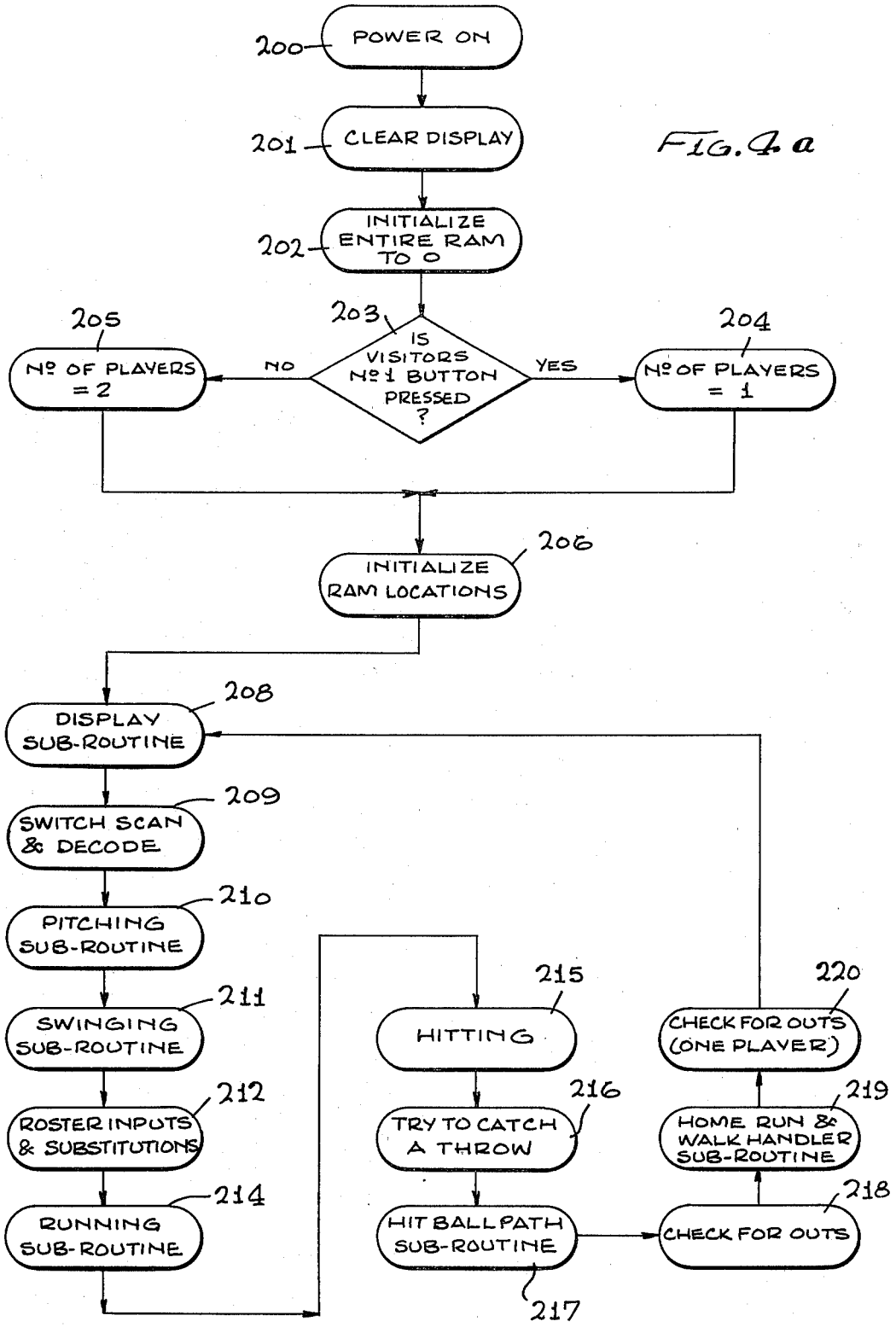
FIGS. 4(*a*)–4(*z*) are flow charts illustrating the operation of the game of this invention.
Figure 4B:
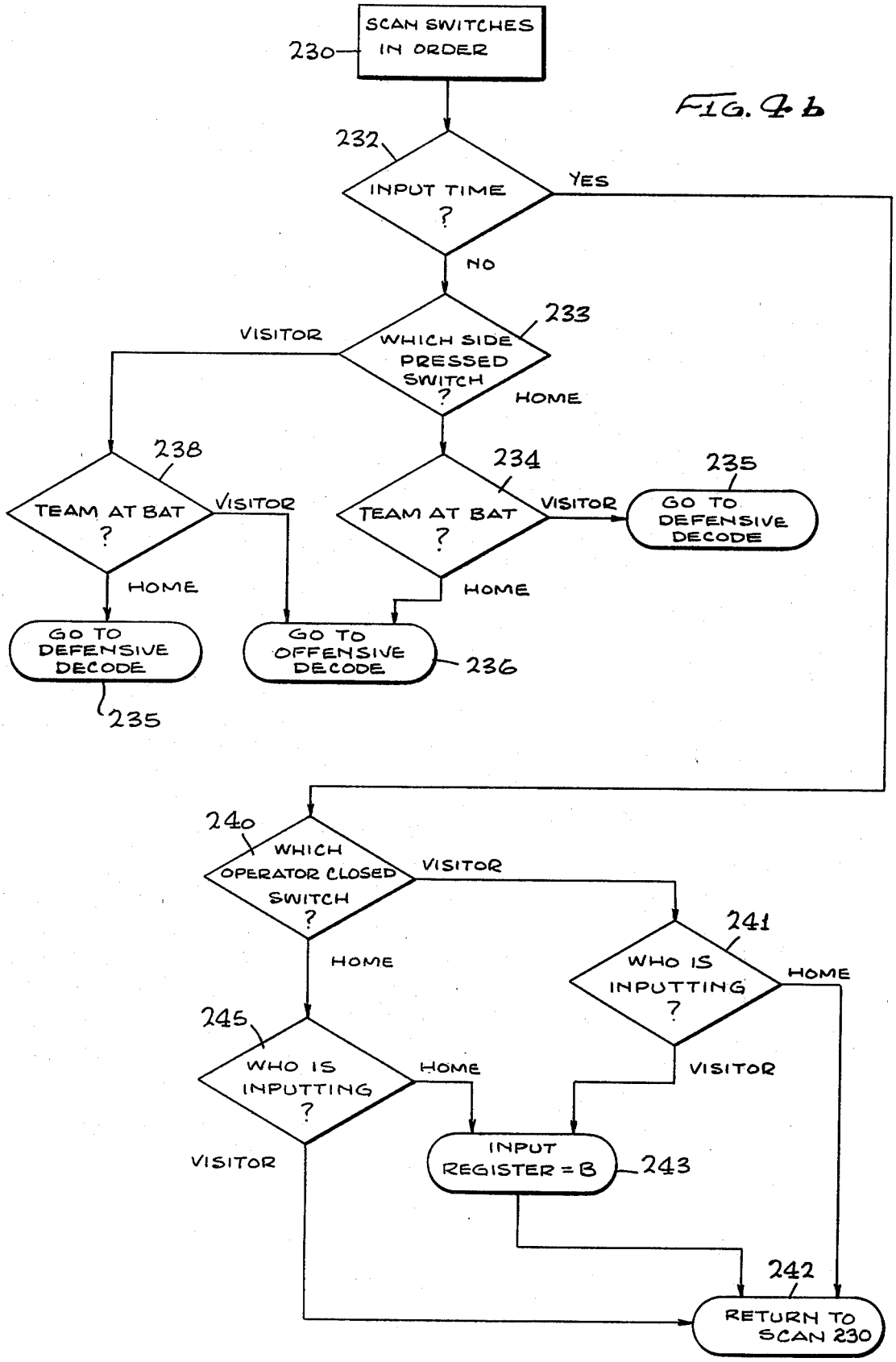
Figure 9C:
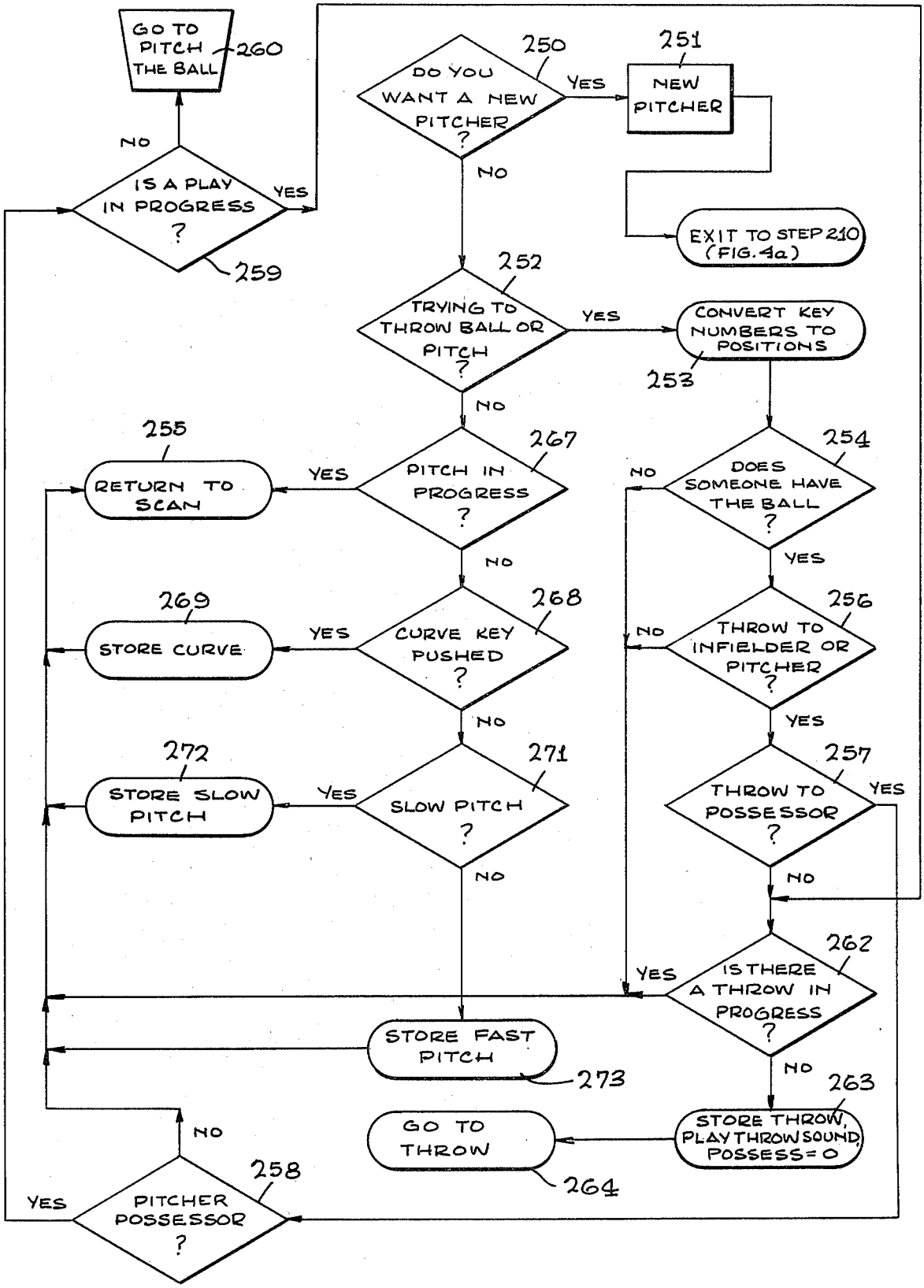
Figure 4D:
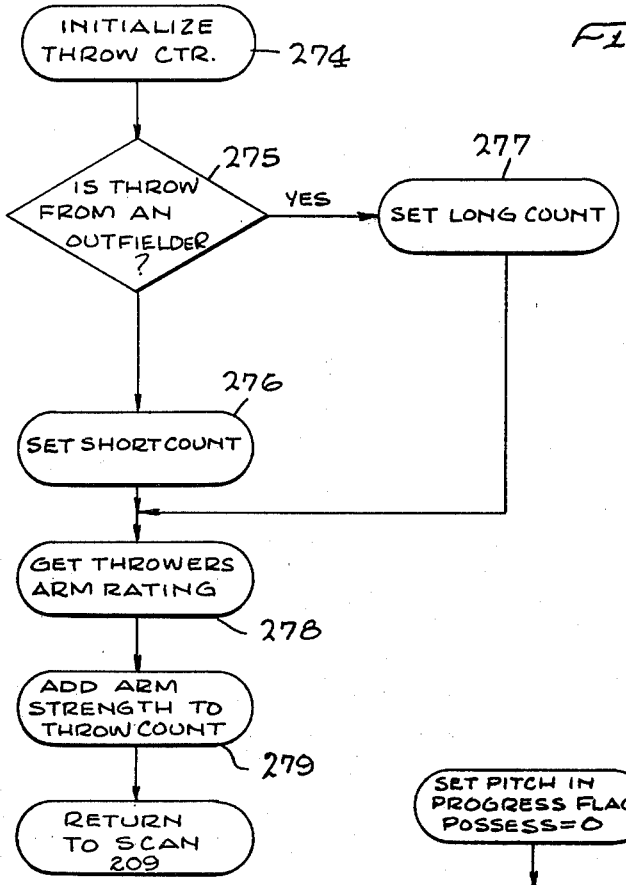
Figure 4E:
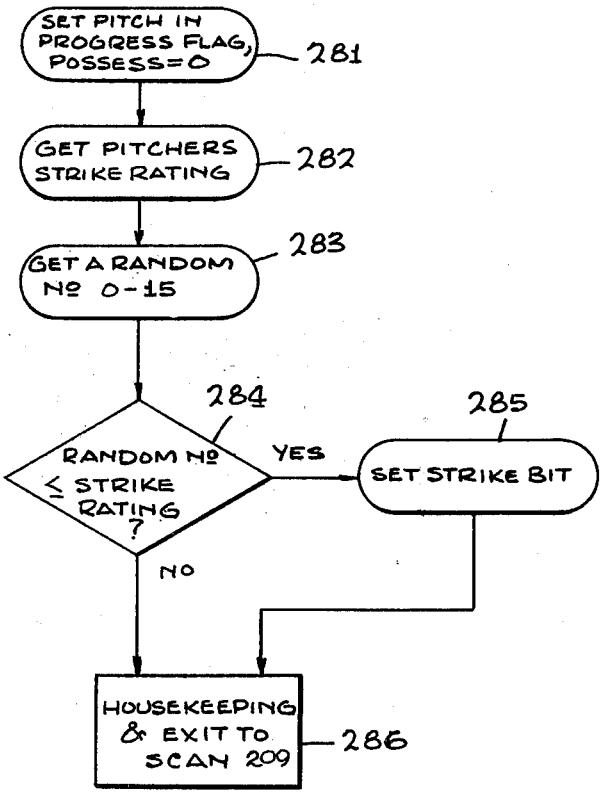
Figure 4F:
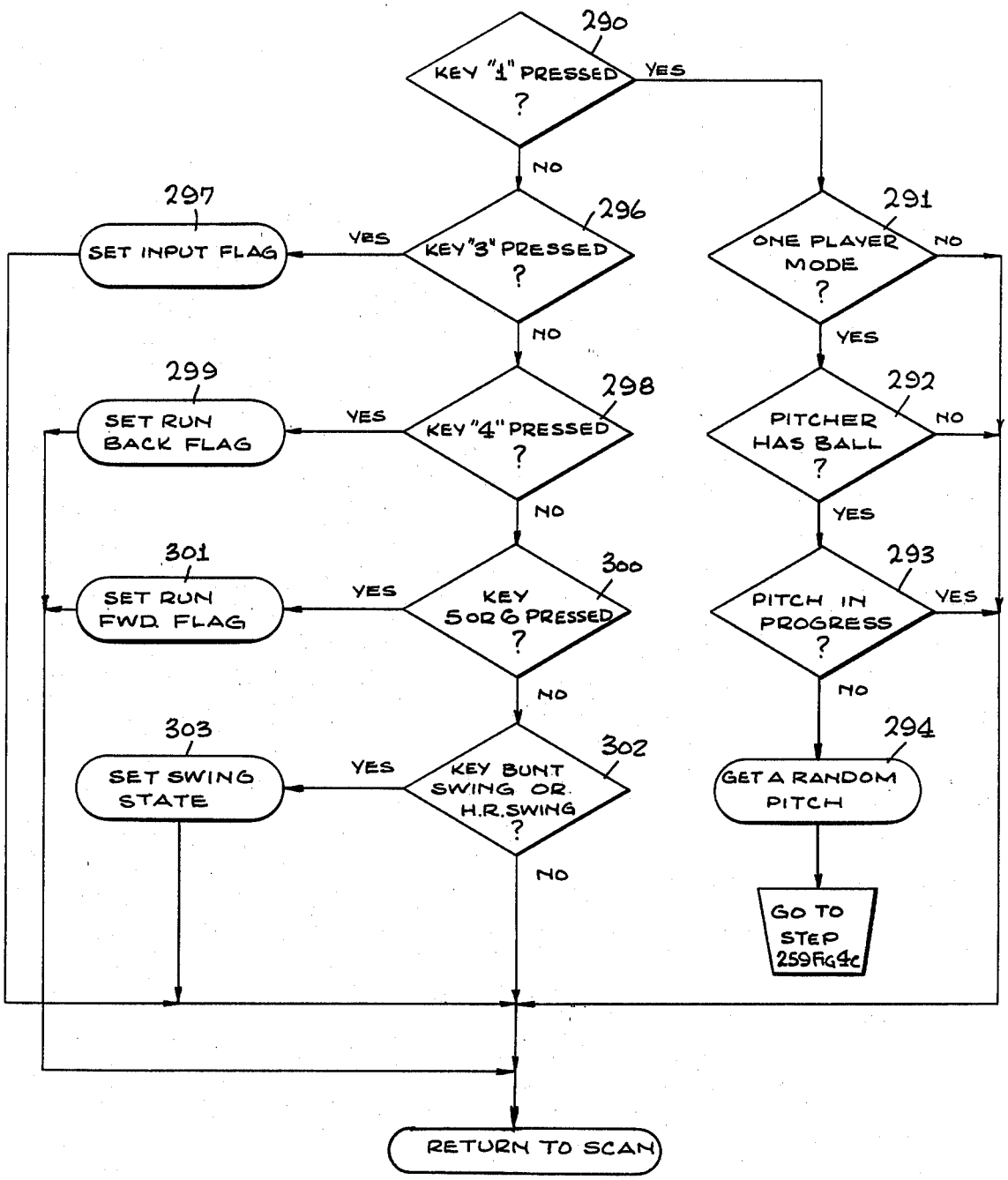
Figure 9G:
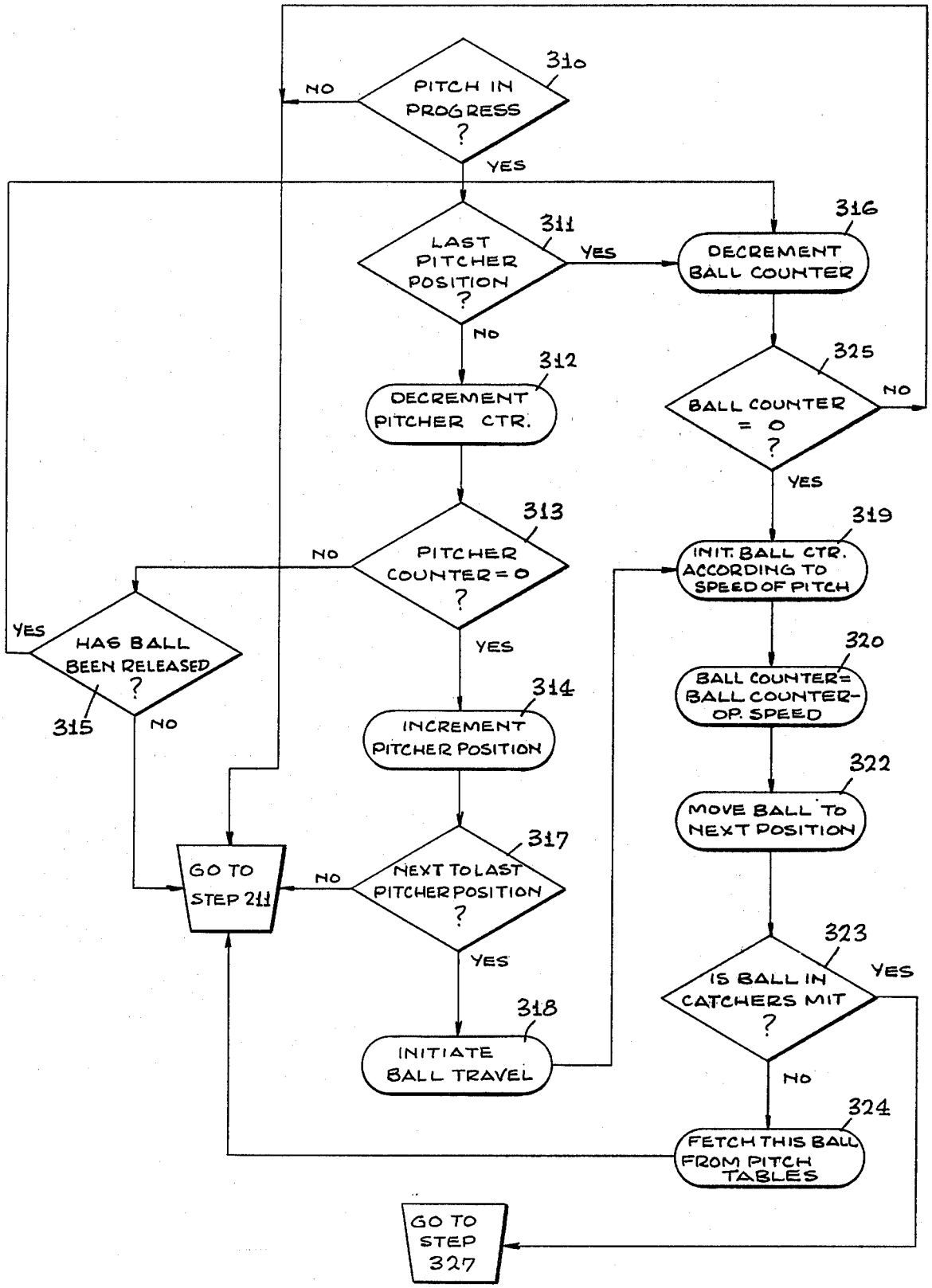
Figure 9H:
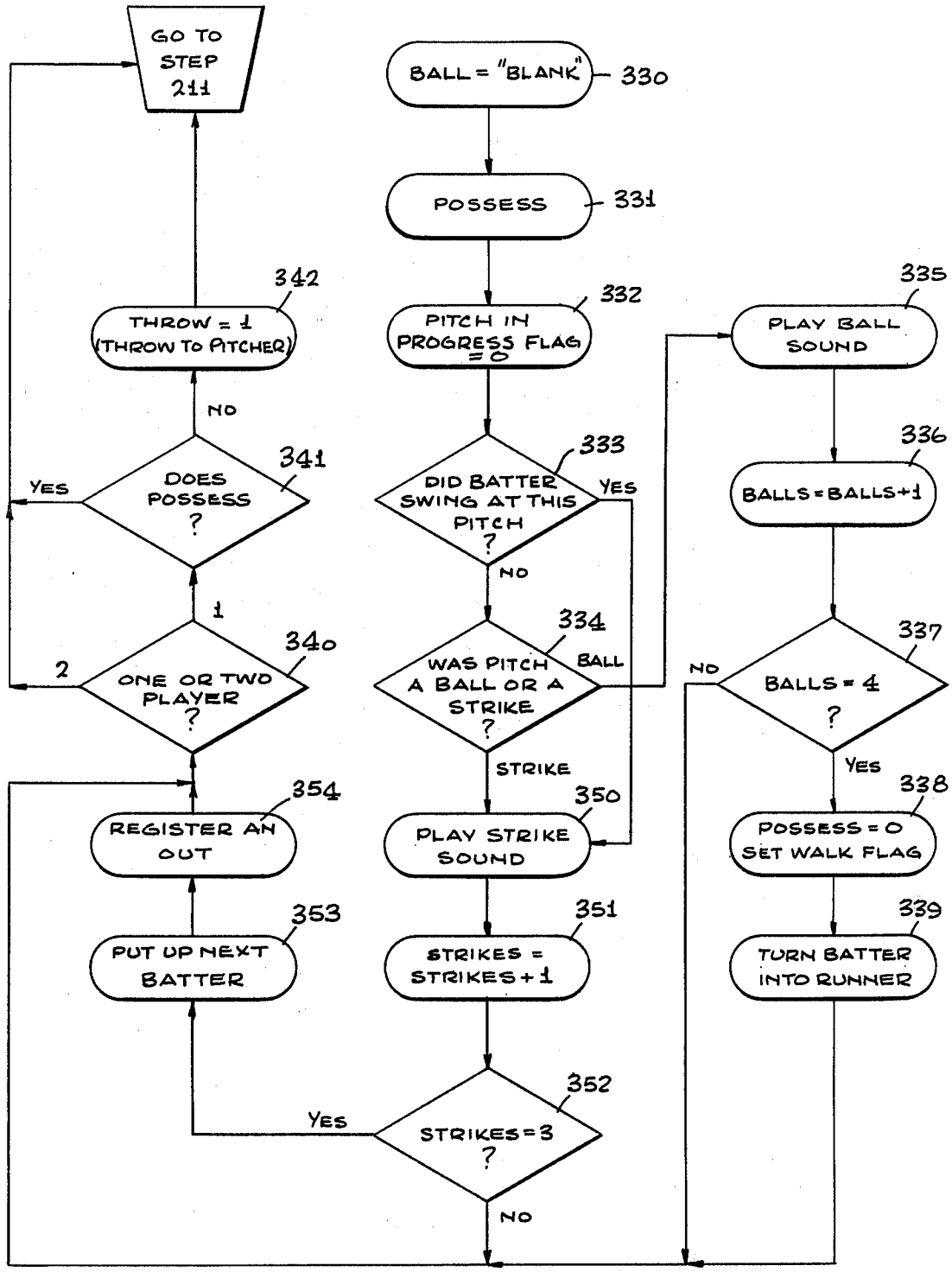
Figures 4I, 4K:
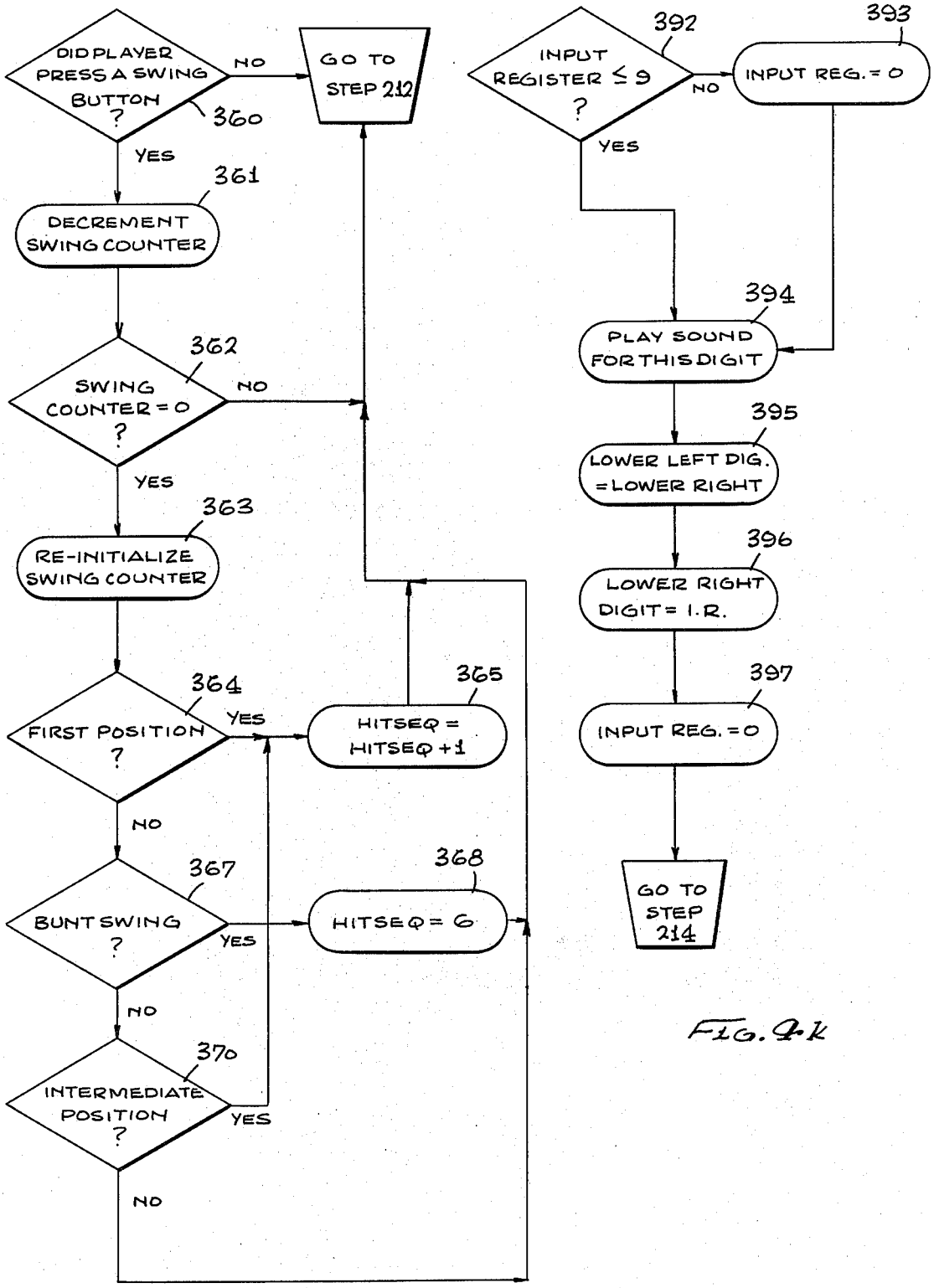
Figure 9J:
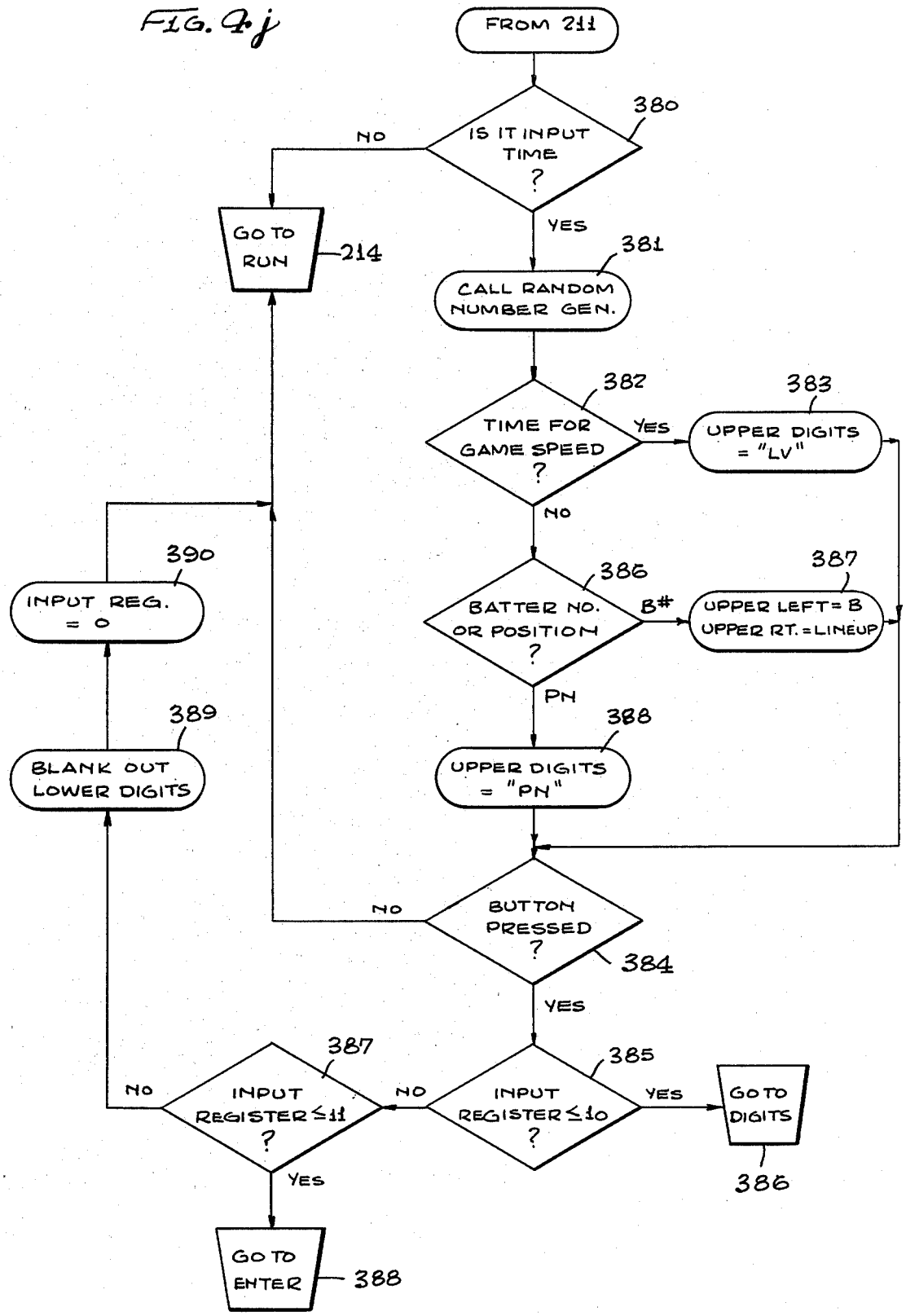
Figure 9L:
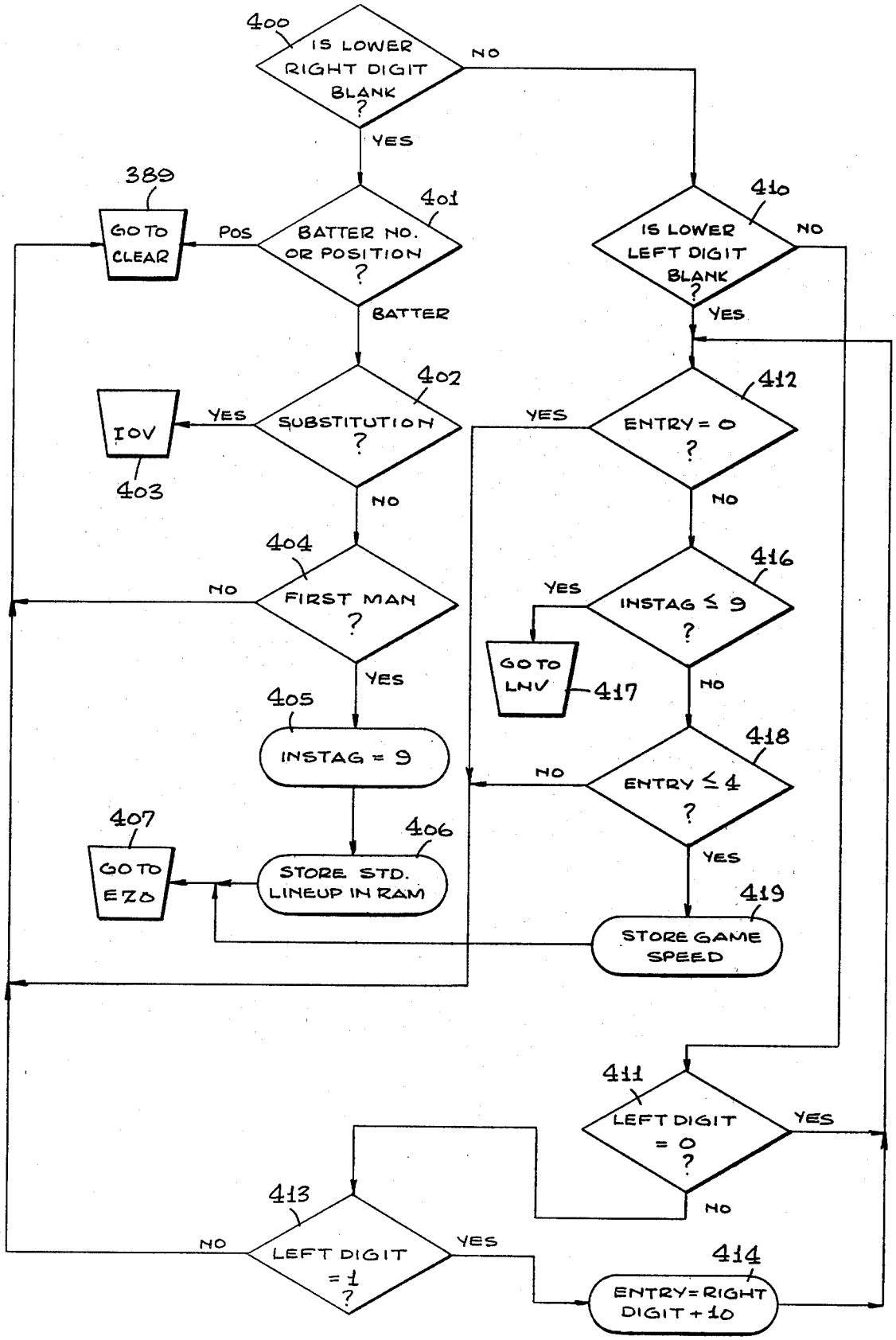
Figure 4M:
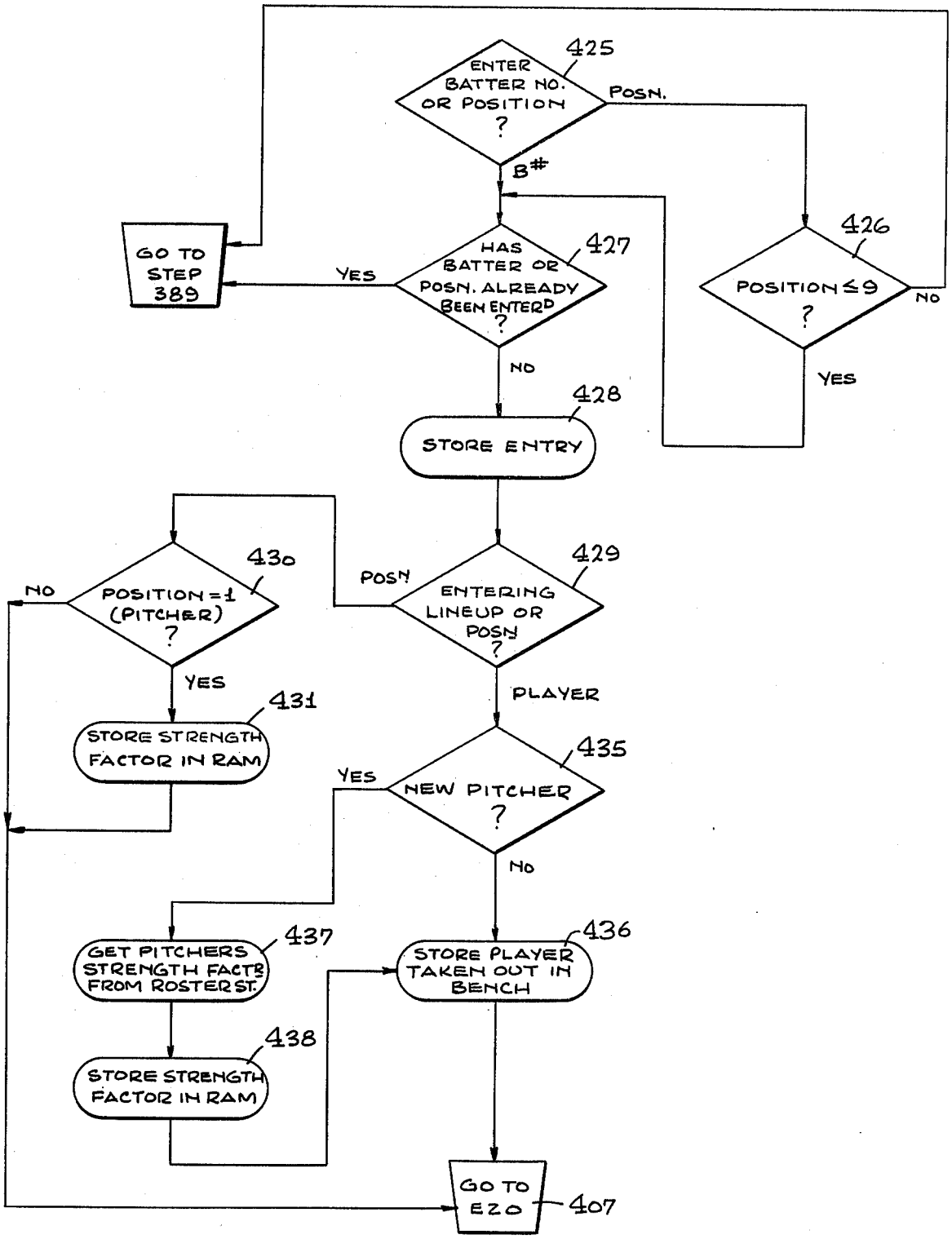
Figure 4N:
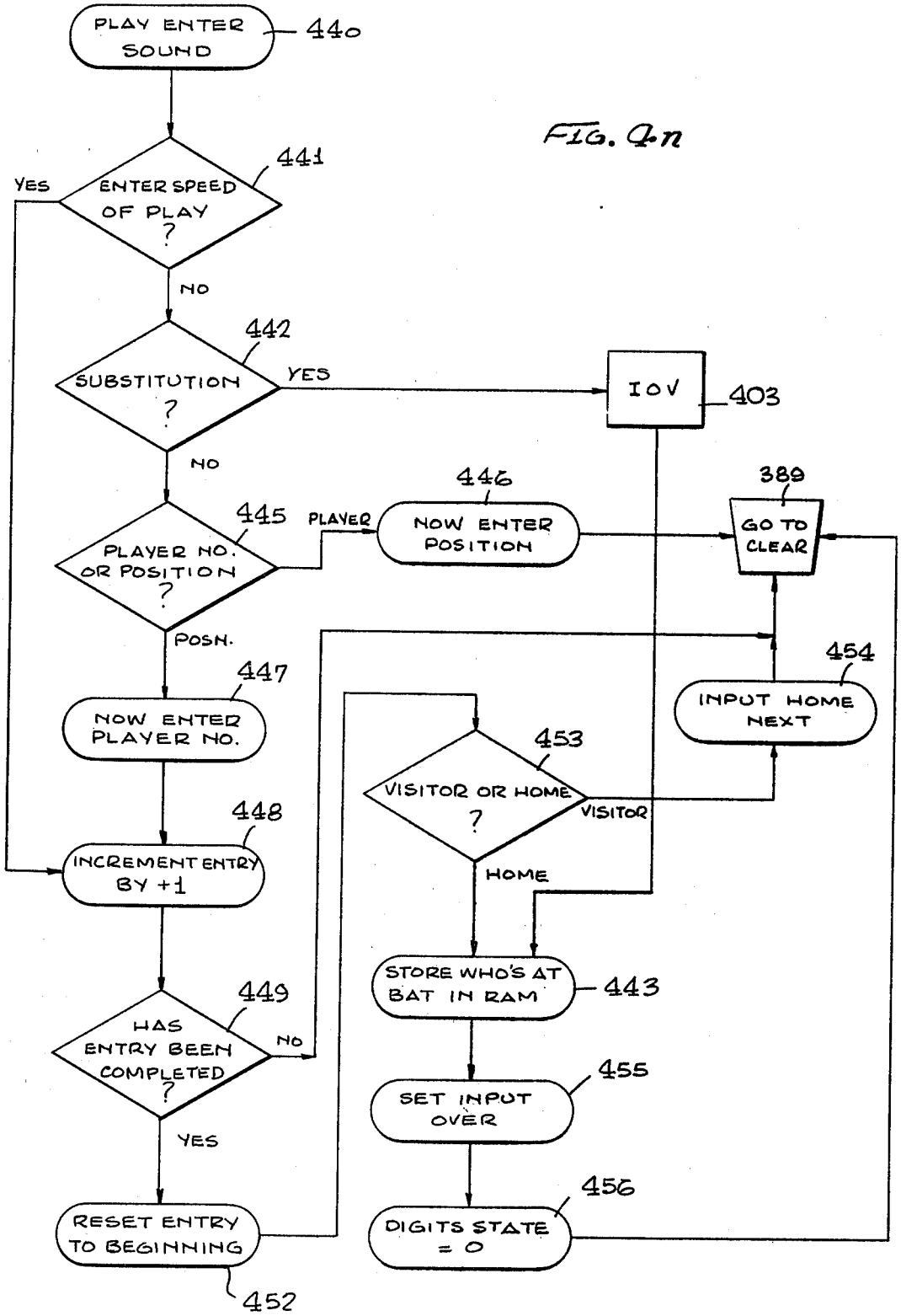
Figure 40:
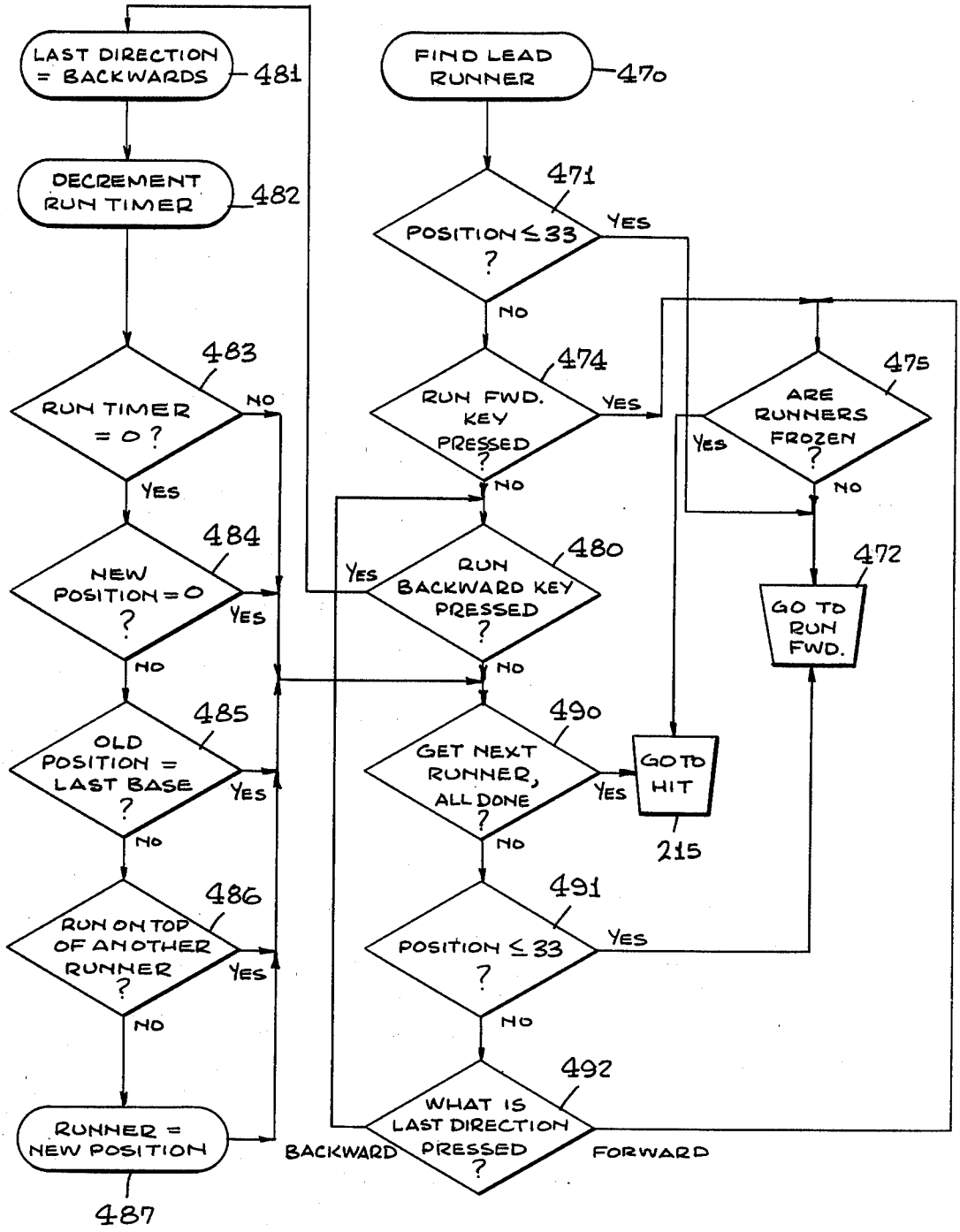
Figure 4P:
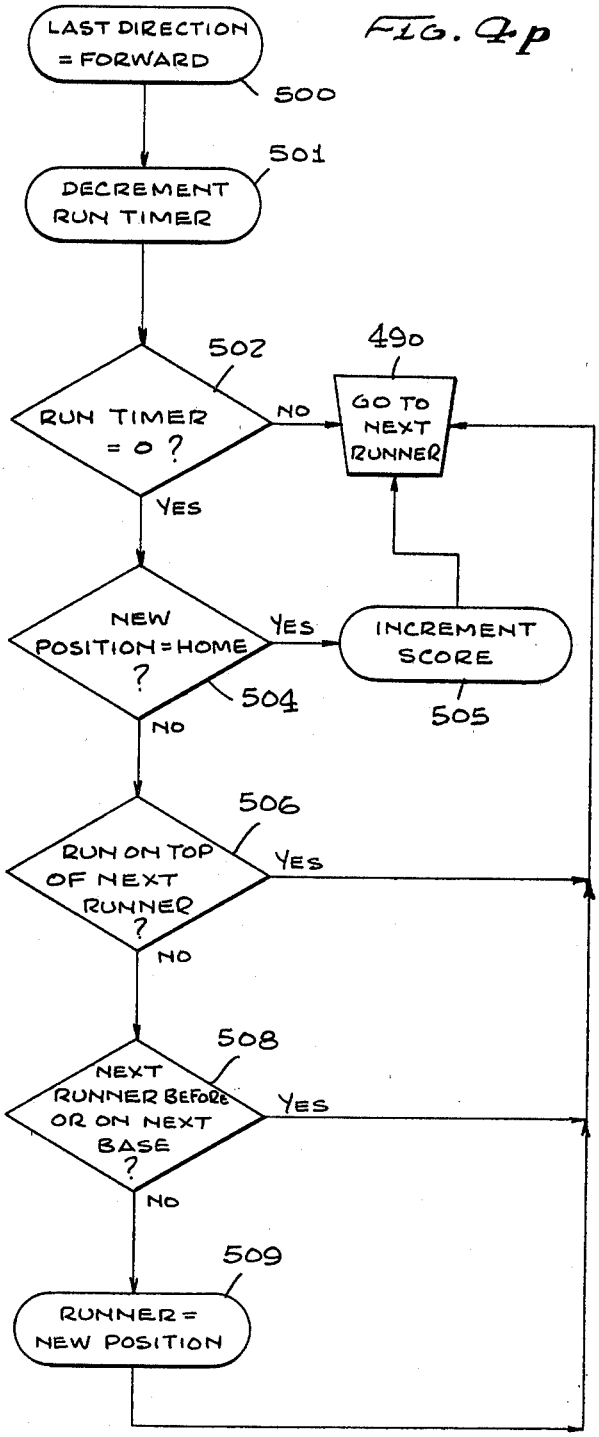
Figure 4S:
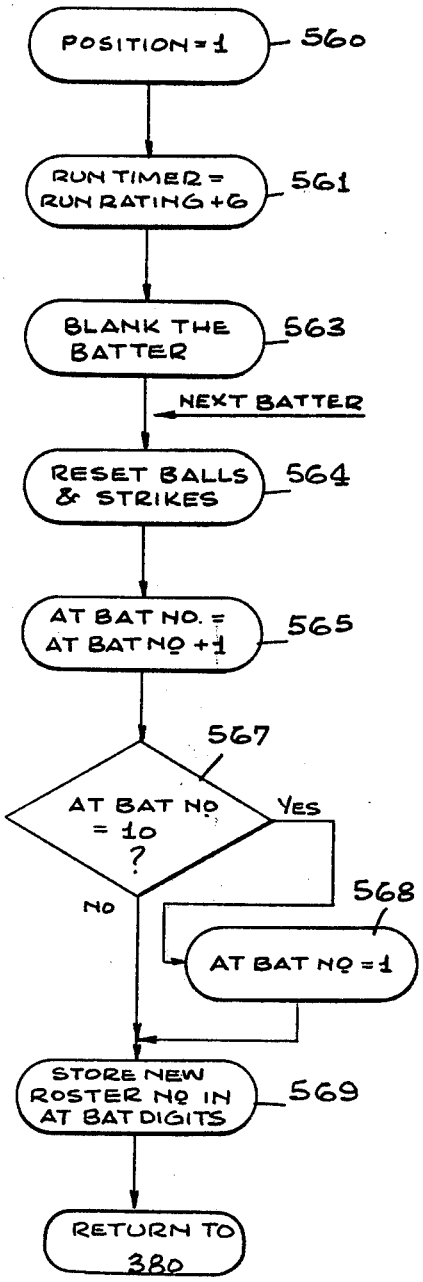
Figure 9Q:
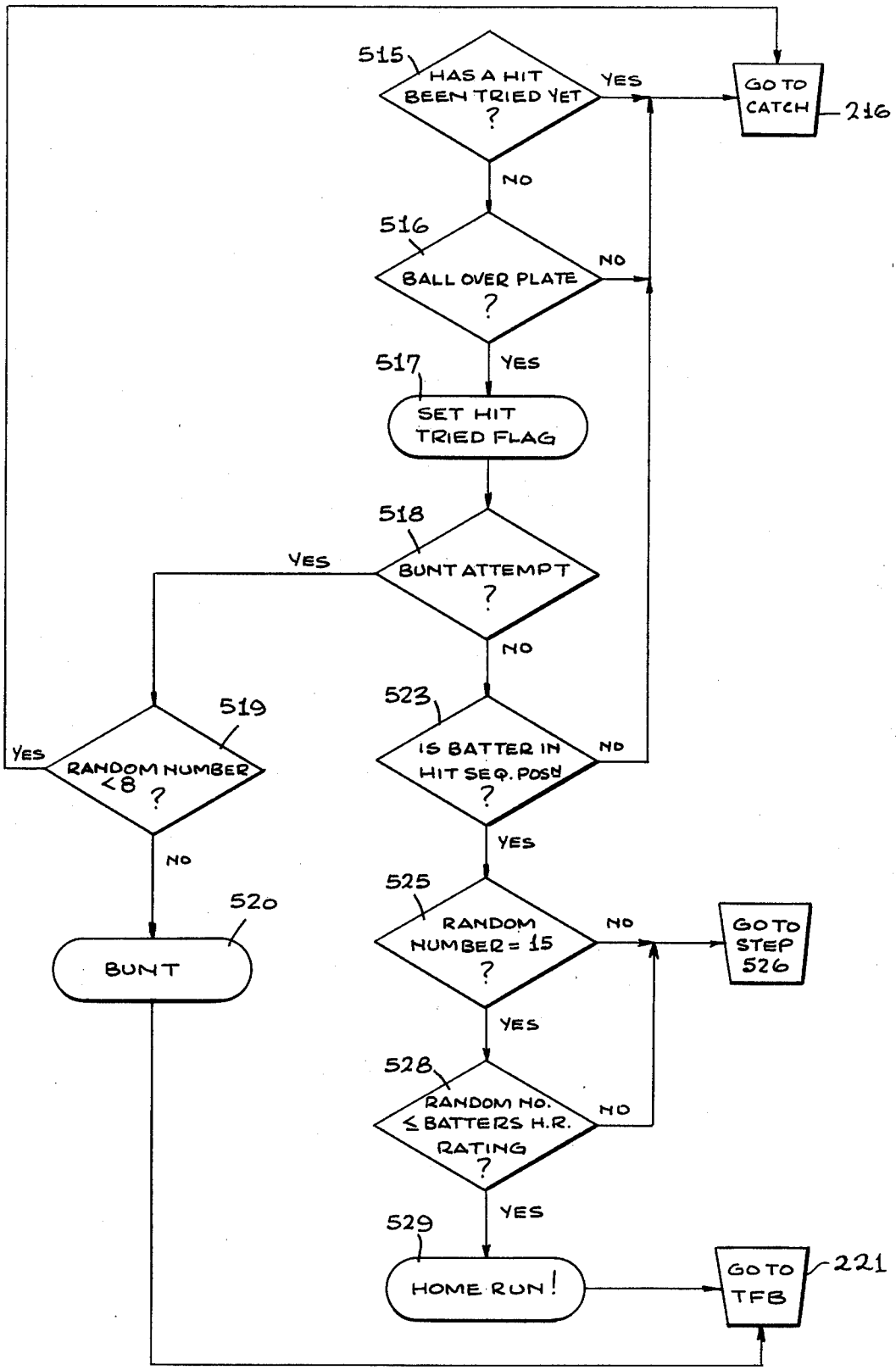
Figure 9R:
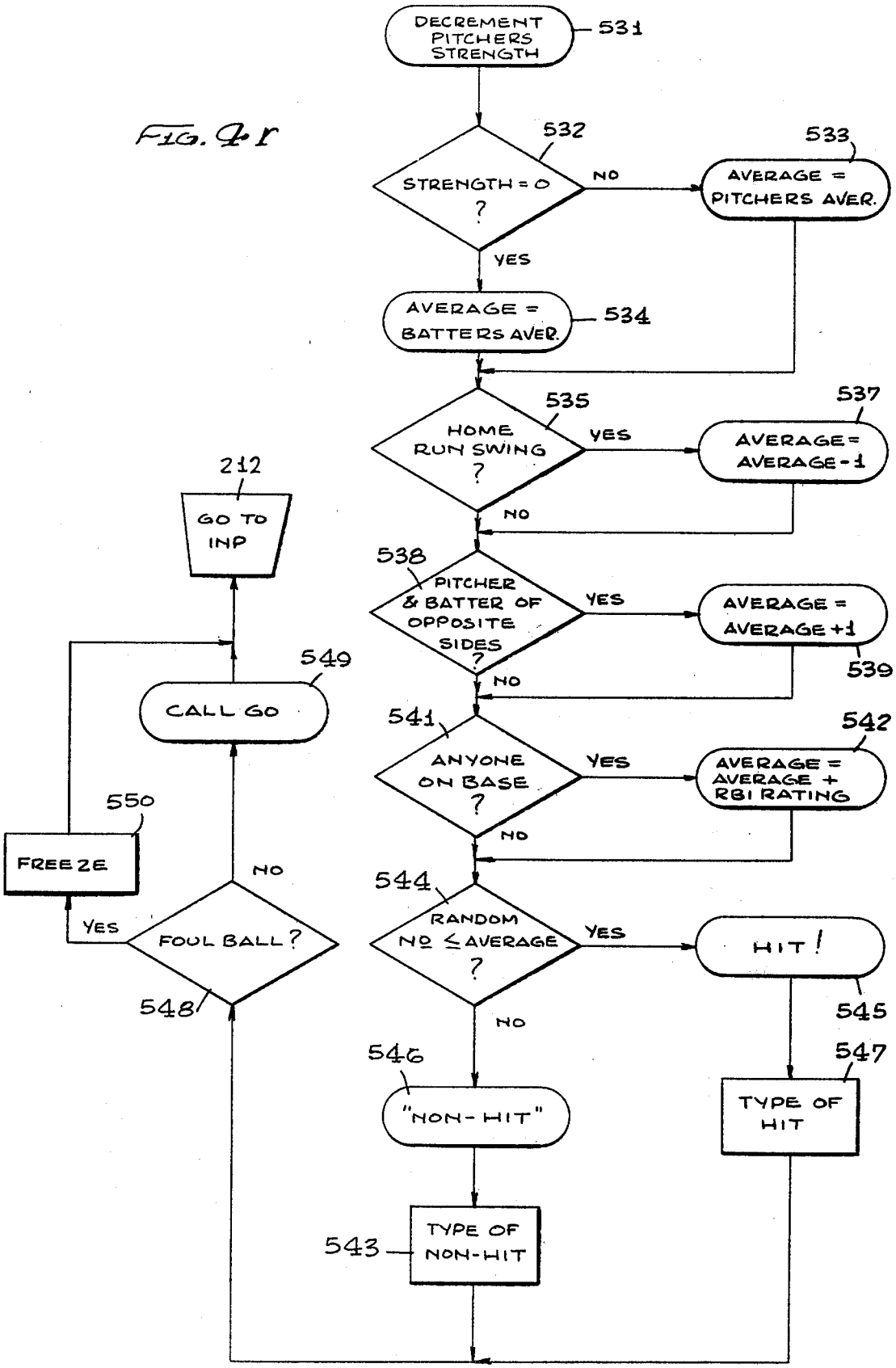
Figures 4T, 4U:
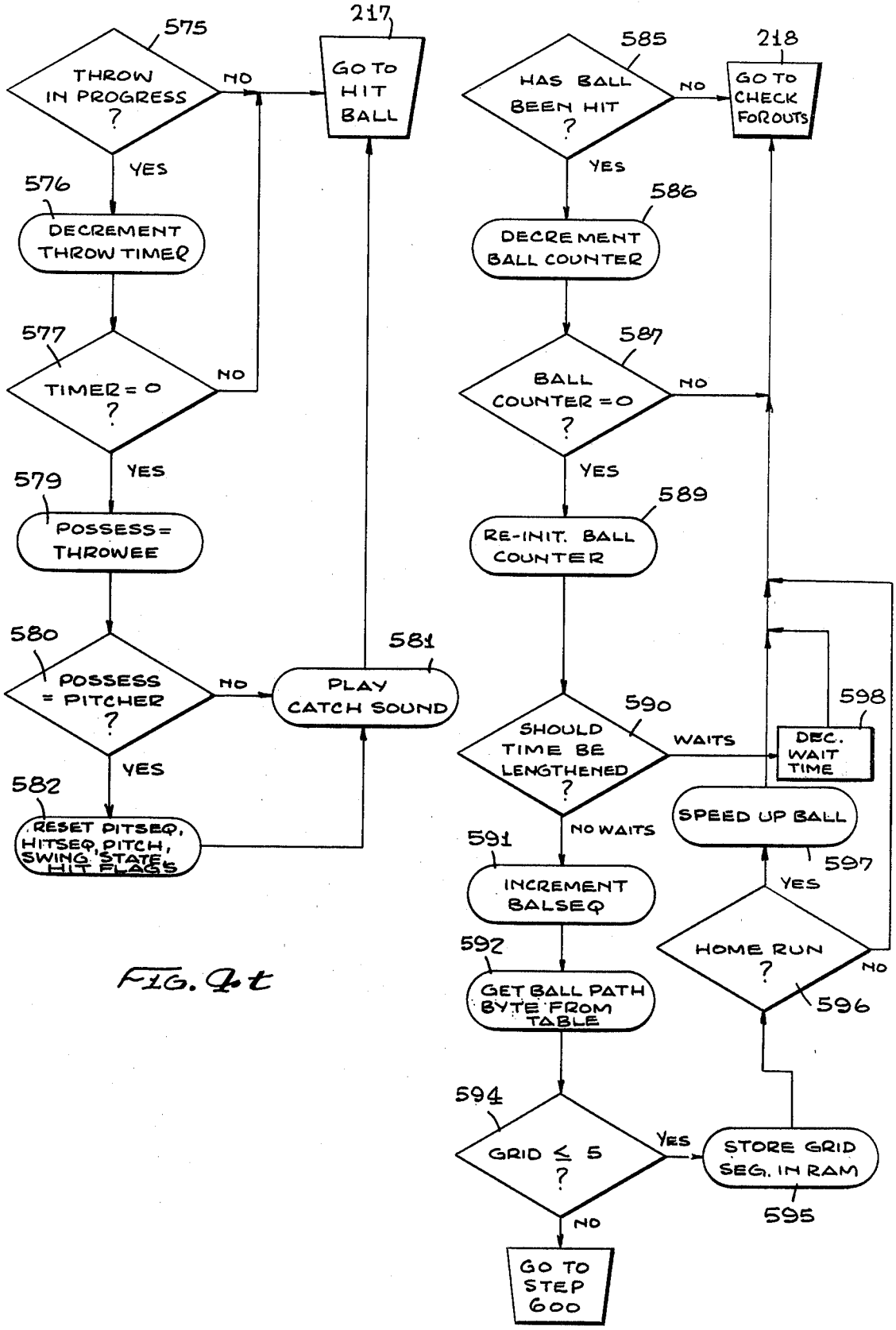
Figure 9V:
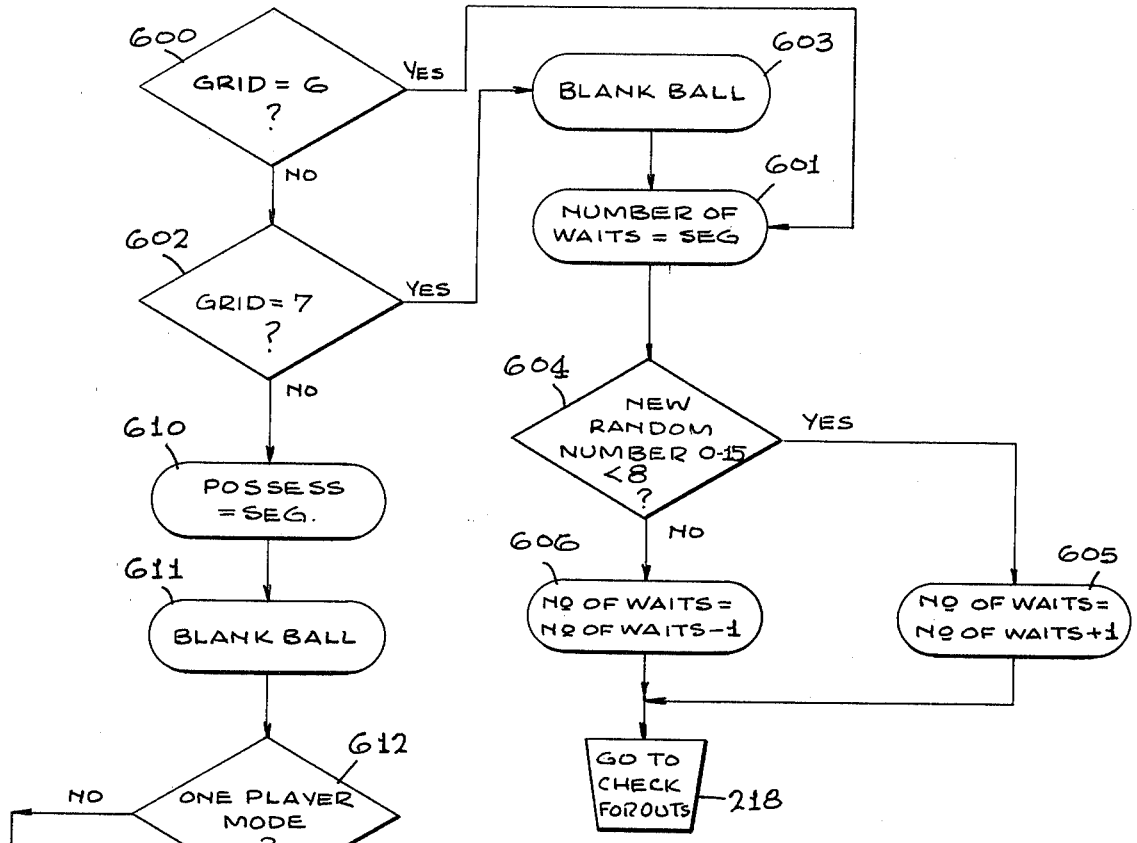
Figure 9X:
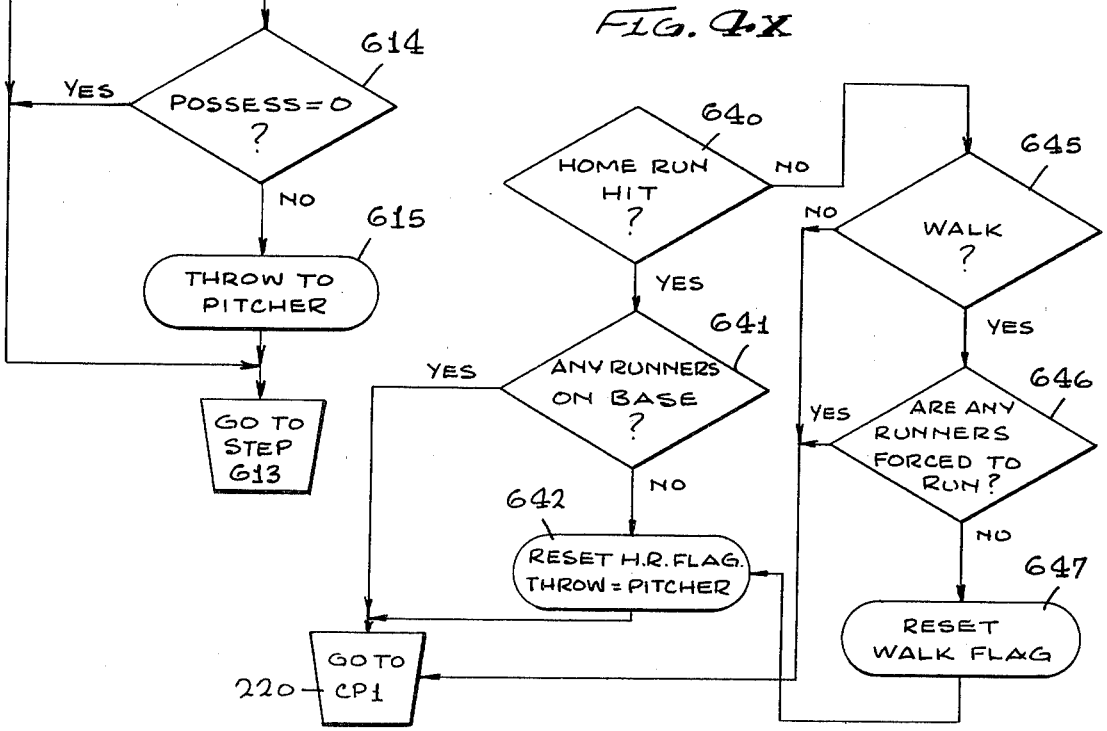
Figure 4Y:
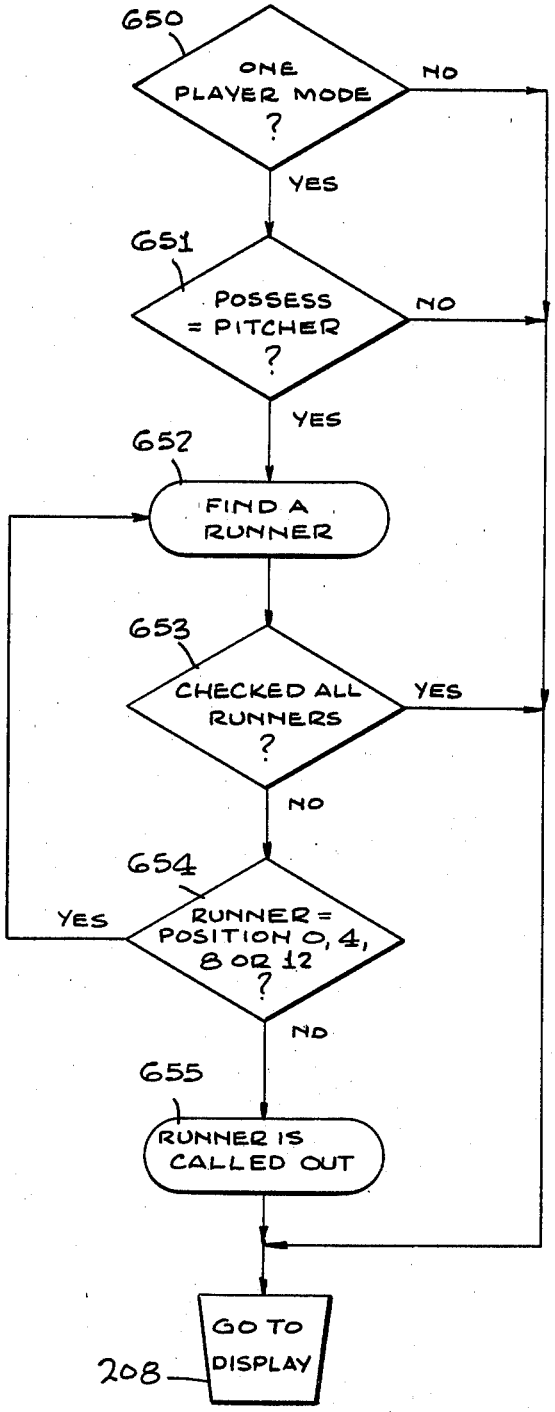
Figure 42:
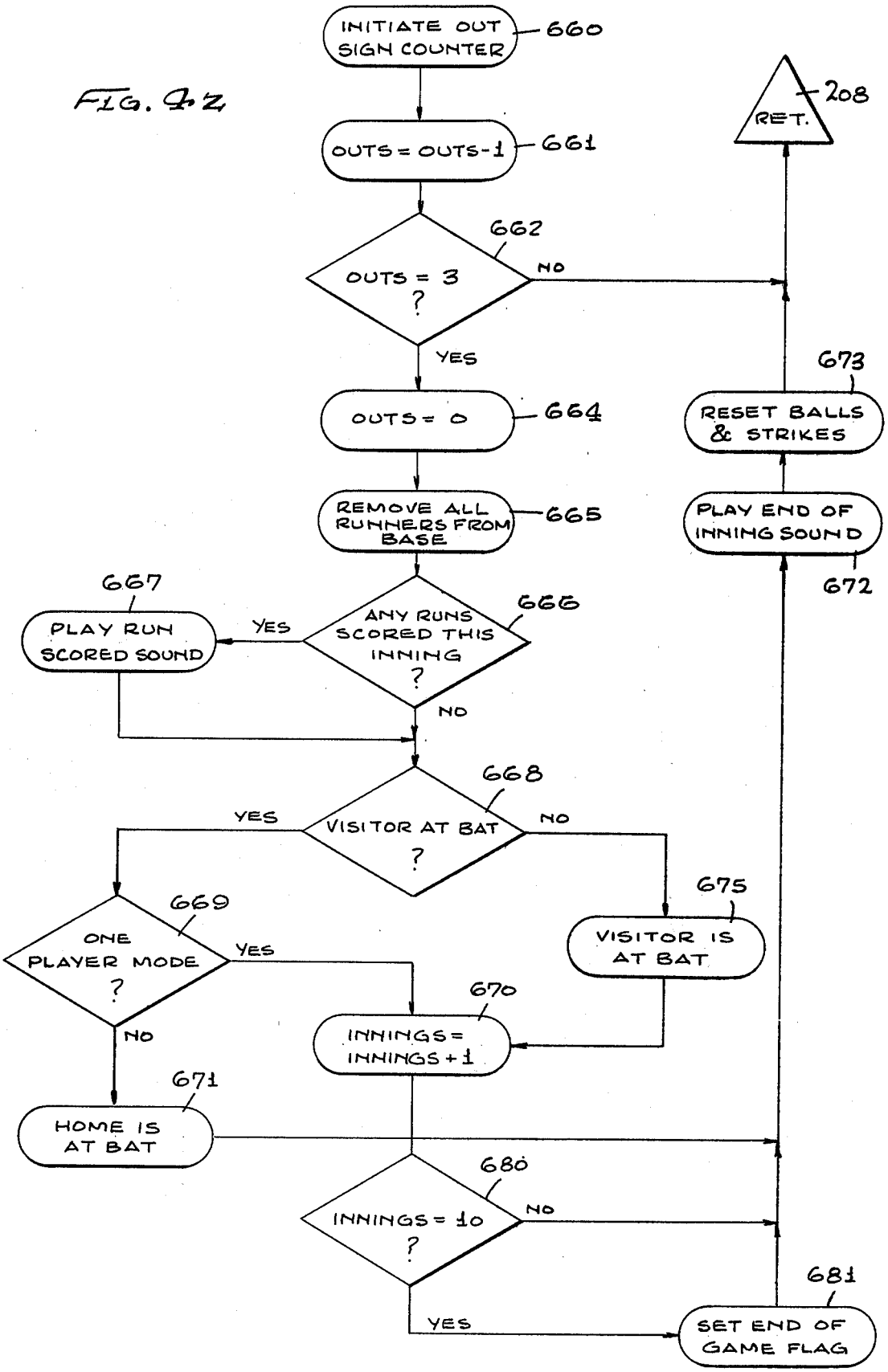

FIG. 3 illustrates a partially block/partially schematic drawing of circuitry which may be used to implement the invention disclosed in the specification. The circuitry includes the keys V1-V9, V0, VC, and VE shown on the visitors' console side of the housing 12 in FIG. 1. The circuit also includes switches $H_1$-$H_9$, H0, HC, and HE shown in the home console of housing 12 in FIG. 1. The switches 18 and 20 are also shown in the upper central portion of FIG. 3. These switches are connected to the various input terminals of a controller circuit 130.

As will be understood by those skilled in the art, the controller 130 may be implemented in any of a number of ways. However, as with many prior art electronic game circuits, the preferred embodiment of the invention utilizes an integrated circuit microprocessor which is, in effect, a miniature digital electronic computer. Such integrated circuit microprocessors are well known and include all of the input, output, memory, logic, and control circuitry of a special purpose digital computer in miniature form. In general, such circuits have both random access memory (RAM memory) and read only memory (ROM memory). The ROM memory has connections formed by masking operations performed during the construction of the basic circuitry of the controller which provides a set of completely wired circuits which include the program for controlling the operation of the microprocessor. Such arrangements are often described as dedicated memory circuits. The RAM memory of the microprocessor is utilized for storage of the various bits of information during the operation of the circuitry.

Although many different microprocessor circuits (each usually produced on a single chip) are offered by a number of manufacturers and are well known to the prior art, a preferred embodiment of the present invention used a Hitachi HMC45A microprocessor. The circuit of the HMC45A is better described in the user's manual therefor published by Hitachi.

The arrangement shown in FIG. 3 has a battery 132 which is connected by the switch 16 in the closed position through a transformer 134 which provides a stepped up AC voltage for operating a fluorescent display 136. The fluorescent display 136 should be considered to include the necessary selection and driving circuitry all of which is well known to the prior art. A second output winding on the transformer 134 provides stepped up input voltages for operating the control circuit 130. A pair of transistors 138 and 140 are connected in an amplifying arrangement to provide alternating current at the input of the transformer 34.

A timing circuit 142 including a capacitor and a resistor is connected to the circuit 130. A speaker 144, which in the preferred embodiment may be a ceramic speaker, is also connected to furnish sound outputs from the circuit 130. The pins of the circuit are 130 are numbered in FIG. 3, and the operation of circuit 130 is better described in the user's manual referred to above.

FIGS. 4(*a*)–4(*z*) together constitute a flow chart describing the operation of the game 10 of this invention. The routine of the flow chart is entered at step 200 at which the power is turned on by moving the switch 16 to the "on" position. The program then moves to step 201 at which the display is cleared and to step 202 at which the RAM is initialized to zero. From step 202 the program moves to step 203 at which it is determined whether the key "V1" has been depressed while the switch 16 is turned on. If the switch has been depressed, a one player mode of the game is chosen, and the program moves to step 204 to store this result in memory. If the key "V1" has not been depressed, the program moves to step 205 to store an indication that a two player mode has been selected. From steps 204 and 205, the program moves to step 206 to initialize selected locations in the RAM memory of the circuit.

From step 206, the program moves to step 208 to accomplish the display subroutine. In this subroutine, each of the players on the display is lit for a sufficient time to provide a persistent image which appears to be continuously on. If one of the defensive players however has the ball in his possession, this player is caused to blink by blanking a portion of the time during which the fluorescent device indicating his position would normally be on. The sequence, in the preferred embodiment, for lighting the defensemen is: pitcher, first baseman, catcher, second baseman, third baseman, shortstop, left fielder, center fielder, and right fielder. After the defenders have been lit on the display, the "OUT?" sign of positions 120–123 is lit if an offensive player has just been called out. After the defensive players and the "OUT?" sign have been lit, the batter is lighted in a like manner and blanked if he has just hit the ball. Thereafter, each of the runner positions is lit, if required, in accordance with the play of the game. After the runner positions are lit, the ball position and the digit indicators 22, 24, 26, and 28 are lit. These indicators show at different times ball and strikes, outs, innings of play, the batter, the score, and a player being added to the roster.

From step 208, the program moves to step 209 to execute a subroutine in which all of the input switches are scanned and the information provided thereby is decoded. From step 209, the program moves to step 210 to a pitching subroutine in which the ball is thrown to the batter. After step 210, the program moves to a swinging subroutine 211 in which the bat is moved through the various positions. The program then moves to step 212 to check for inputs of batting orders and for substitutions.

After the input subroutine of step 212, the program moves to step 214 and moves through the running subroutine in which runners proceed around the bases. From the running subroutine at step 214, the program moves to step 215 in which the determination of whether a ball is hit by the batter is accomplished. The program then moves to step 216 in which a subroutine during which the fielders catch a ball is implemented. From step 216, the program moves to step 217 to implement a ball path subroutine once a ball has been hit. The program then moves to step 218 to check for outs in a two player game, and to step 219 to implement a subroutine for home runs and walks. From step 219, the program moves to step 220 to check for outs in a one player game. After step 220, the program recycles to step 208 and repeats continuously during the operation of the game.

The flow chart shown in FIG. 4(*a*) illustrates the overall operation of this invention. The various steps describing the subroutines of this routine will be explained in detail in the various figures which follow.

FIG. 4(*b*) is a flow chart showing a subroutine used in a preferred embodiment of the invention for accomplishing step 209 shown in FIG. 4(*a*). The subroutine is entered at step 230 at which the various input switches on the visitor and home sides of the game 10 and the switches 16 and 18 are scanned in order to determine whether any of those switches have been activated. The program then moves to step 232 at which a determination is made as to whether it is the correct point in the sequence to accept input information. If it is not the correct time, the program moves to step 233 to determine whether the home or the visitor operator depressed the particular switch. If the home operator depressed the switch, the program moves to step 234 to determine whether the home or visitor team is at bat. If the home team operator pushed the switch and the visiting team is at bat, the program moves to step 235 to implement the defensive decode routine. If the home team operator pressed the switch and the home team is at bat, the program moves to step 236 to implement the offensive decode routine.

If at step 233 the operator controlling the visiting team depressed the switch, the program moves to step 238 to determine which team is at bat. If the visiting team is at bat and its operator has pressed the switch, the program moves to step 236 to implement the offensive decode routine. If the home team is at bat and the visitors' operator depressed the switch, the program moves to step 235 to implement the defensive decode routine.

If at step 232 it is time for inputting information, the program moves to step 240 to determine which operator closed the switch. If the operator controlling the visiting team closed the switch, the program moves to step 241 to determine who is presently inputting information. The operator controlling the visiting team cannot input information during the time the other operator is providing input. Consequently, if the period is that in which the home team should be inputting information, the program moves to step 242 and returns to the scan ignoring the input of the operator of the visiting team. If at step 241 the visitor is presently inputting information, the program moves to step 243 to store the information in an input register of the RAM. If at step 240 the home team began the input of information, the program moves to step 245 to determine whether the operator controlling the home team or the visiting team is presently inputting information. If the visitor's operator is inputting the information, the program moves to step 242 to return to the switch scan while if the home team is presently inputting information, the program moves to step 243 to store the information in the input register of the RAM.

The subroutine of step 235 is expanded in FIG. 4(*c*) which illustrates a preferred embodiment of a subroutine for accomplishing the defensive decoding. The defensive decode subroutine is entered at step 250 at which a determination is made whether the key "1" controlling the team at field has been depressed indicating that a new pitcher is desired. If a new pitcher is desired, the program moves to step 251 to enter this information in memory and then exits the subroutine. If a new pitcher is not desired at step 250, the program moves to step 252 to determine whether an attempt is being made to throw or pitch the ball as indicated by the depression of keys indicating any of the infielders (including the pitcher). If an operator is trying to throw the ball at step 252, the program moves to step 253 to convert the key numbers to fielder numbers and then to step 254 to determine whether one of the fielders presently has the ball; for without the ball a fielder cannot throw it. If the ball is out of any fielder's possession, the program moves to step 255 and returns to the remainder of the scan routine. If at step 254, one of the fielders has possession of the ball, the program moves to step 256 to determine whether the throw is being made to an infielder or the pitcher (the only throws allowed). If it is not, the program moves to step 255 and returns to the scan subroutine.

If the throw is being made to an infielder or the pitcher, the program moves to step 257 to determine whether the throw is being made to the field which possesses the ball. This can only be accomplished in the case of the pitcher having the ball and the key "5" being depressed to indicate the start of a pitch; consequently, the program moves to step 258 to determine whether the possessor is the pitcher. If at step 258 the throw by the possessor of the ball to the possessor of the ball is not to the pitcher, an error has been made and the program moves to step 255 to return to scan. If the possessor is the pitcher, the program moves to step 259 to determine whether a play is presently in progress; and, if a play is not in progress, to step 260 to initiate the pitch of the ball. If a play is in progress, the program moves to step 262.

The program also moves to step 262 from step 257 where the throw is not attempted to the fielder that possesses the ball. At step 262, a determination is made as to whether there is already a throw in progress. If so, the program moves to step 255 to return to the scan subroutine. If a throw is not in progress at step 262, the program moves to step 263 to store an indication of the throw, to cause a throw sound to be emitted by the speaker 144 of the game 10, and to store an indication that no fielder presently possesses the ball. From step 263 the program moves to step 264 to initiate the throw subroutine.

If at step 252 an operator is not trying to throw or pitch the ball, the program moves to step 267 to determine whether a pitch is presently in progress. If a pitch is in progress, the program moves to step 255 and returns to the scan subroutine. If a pitch is not in progress at step 267, the program moves to step 268 to determine whether the key "0" has been depressed indicating that a curve is being pitched. If a curve is being pitched, the program moves to step 269 to store this indication and then returns to step 255. If the key "0" has not been depressed at step 268, the program moves to step 271 to determine whether the key "C" has been depressed indicating that a slow pitch is to be thrown. If so, the program moves to step 272 to store this indication in memory and then returns to step 255. If not, the program moves to step 273 to store an indication that a fast pitch is desired and then moves to step 255 to return to the scan subroutine.

The subroutine of step 264 for accomplishing the throw of the baseball to a fielder is shown in the flow chart of FIG. 4(*d*). The subroutine commences at step 274 at which a throw counter is initialized. The program then moves to step 275 to determine whether the throw is from an outfielder. If the throw is from an outfielder, the program moves to step 277 to cause the throw counter to count for a longer period for a throw from the outfield than from the infield. If the throw is not from an outfielder at step 275, the program moves to step 276 to set the throw counter for a fast count for a throw from an infielder. From each of steps 276 and 277, the program moves to step 278 to select from memory the indication of the thrower's arm strength. The arm strength is recorded in memory and at step 279 is used to lengthen the time of throw for a player with low arm strength. From step 279, the program returns to the scan subroutine.

FIG. 4(*e*) illustrates a subroutine to which the program moves from step 260 shown in FIG. 4(*c*) in order to initiate a pitch. The program commences at step 281 at which an indication is stored that a pitch is in progress and the possession has left any fielder. The program then moves to step 282 to select from memory the pitcher's strike rating. The pitcher's strike rating is stored (in the preferred embodiment) as a number between zero and fifteen. The program them moves to step 283 at which a random number between zero and fifteen is selected and to step 284 to determine whether that random number is less than or equal to the strike rating of the pitcher. If the random number is less than or equal to the strike rating of the pitcher, the program moves to step 285 to store an indication in memory that a strike will be thrown and then moves to step 286 to perform various housekeeping functions and exits to the scan subroutine. If at step 284 the random number is greater than the strike rating of the pitcher, the program moves directly to step 286 and exits the subroutine after storing an indication that a ball is to be thrown.

It will be noted that the use of the pitcher's strike rating and the selection of a random number allows a pitcher with a greater strike rating to throw a greater number of strikes. For example, if the pitcher's strike rating were fifteen, then no random number could be greater than the strike rating and all pitches thrown by that pitcher would be strikes. On the other hand, if the pitcher's strike rating were seven, then in approximately seven out of fifteen cases strikes would be thrown, while in eight out of fifteen cases, balls would be thrown.

FIG. 4(*f*) illustrates a preferred embodiment of a subroutine for the offensive decode step shown in step 236 of FIG. 4(*b*). The subroutine is entered at step 290 where a determination is made whether the key "1" has been depressed on the visitors' console indicating that in the one player mode a pitch is to be thrown. If so, the program moves to step 291 to determine whether the game is in the one player mode. If the game is not in the one player mode, the program returns to the scan subroutine.

If the game is in the one player mode, the program moves to step 292 to determine whether the pitcher presently has the ball so that a depression of the key "1" means the pitch is to be thrown. If the pitcher does not have the ball, the program moves to the scan subroutine. If the pitcher has the ball, the program moves to step 293 to determine whether a pitch is presently in progress. If a pitch is in progress, the depression of the key "1" is in error and the program returns to the scan subroutine. If a pitch is not in progress, the program moves to step 294 to select a pitch at random and to step 259 shown in FIG. 4(*c*) to complete the pitch of the ball.

If at step 290 the key "1" has not been depressed, the program moves to step 296 to determine whether the key "3" has been depressed. Depression of the key "3" for the offensive team indicates that a substitution is to be made, and the program moves to step 297 to store an indication that an input is to be made. The program then returns to the scan subroutine. If at step 296 the key "3" has not been depressed, the program moves to step 298 to determine whether the key "4" has been depressed indicating that a runner is to be moved backwards. If key "4" has been depressed, the program moves to step 299 to store this indication in memory and then returns to the scan subroutine. If key "4" has not been depressed, the program moves to step 300 to determine whether the pitch or the run forward keys "5" and "6" have been depressed. If either of these keys has been depressed, the program moves to step 301 to set this indication in the memory of the control circuit 130 and then returns to the scan subroutine. If neither of these keys have been depressed at step 300, the program moves to step 302 to determine whether either of the keys "C" or "E" indicating, respectively, a bunt or a home run swing has been depressed. If so, the program moves to step 303 to store the particular state of the swing in memory and then returns to the scan subroutine. If neither key "C" nor "E" has been depressed, the program moves directly to the scan subroutine.

FIG. 4(*g*) illustrates a flow chart used in the preferred embodiment for the pitching subroutine illustrated in step 210 shown in FIG. 4(*a*). The subroutine is entered at step 310 where a determination is made as to whether a pitch is presently in progress. If no pitch is in progress, the program moves to step 211 shown in FIG. 4(*a*) to implement the swinging subroutine. If a pitch is in progress at step 310, the program moves to step 311 to determine whether the pitcher is in the last position of the pitch. During the windup and the throw, there are five different positions for the pitcher and the fifth position is considered the last position. If the pitcher has not yet reached the fifth position, the program moves to step 312 to decrement a pitcher counter. The pitcher counter is used to determine the time during which the display shows each pitcher position. From step 312, the program moves to step 313 to determine whether the pitcher counter has counted to zero so that the display should change to the next pitcher position. If the pitcher counter has counted to zero, the program moves to step 314 at which the pitching sequence on the display is incremented by one position. If at step 313 the pitcher counter has not yet counted to zero, the program moves to step 315 to determine whether pitcher position four at which the ball is released has been reached. If position four has been reached and the ball has been released, the program moves to step 316 to decrement the ball counter which counts the time at each position of the ball. If the ball has not yet been released at step 315, the program moves to step 211 to implement the swinging subroutine.

From step 314, the program moves to step 317 to determine whether the pitching sequence has yet reached position number four at which the ball is released. If the pitching sequence has not reached position four, the program moves to step 211 shown in FIG. 4(*a*). If the pitching sequence has reached position four, the program moves to step 318 to initiate the ball travel sequence and then to step 319 to adjust the ball counter according to the speed of the pitch. It will be recalled that pitches are thrown at slow, normal, and fast speeds; and a slow speed will require more counts at each ball position. From step 319, the program moves to step 320 at which the ball counter count is reduced by an amount signifying the speed at which the game is operating. For example, the game operates at a first, second, third, and fourth speed which increase with number so that the ball counter time would be reduced as the game speed increases.

From step 320, the program moves to step 322 to move the ball to the next ball position and then to step 323 to determine whether the ball has yet reached the catcher's mitt. If the ball has not reached the catcher's mitt at position 78, the program moves to step 324 to select the next ball position of the pitch from a pitching lookup table stored in the ROM memory and then moves to step 211 shown in FIG. 4(*a*).

Once the ball has been released, as the program moves through the pitching routine and reaches step 311, a determination will finally be made that the pitcher is in the last pitching position and the program moves to step 316 to decrement the ball counter which counts the time at each ball position and then to step 325 to determine whether the ball counter has reached zero so that it is time to move to the next ball position.

From step 325 if the counter has reached zero, the program moves to step 319 to determine the speed of the pitch and continues through the program as explained above. If the count is not yet zero, the program moves to the subroutine of step 211 shown in FIG. 4(*a*).

When the program reaches step 323 and it is determined that the ball is in the catcher's mitt at position 78, the program moves to step 327 which is shown as a subroutine in FIG. 4(*h*). At the end of the pitch, as shown in FIG. 4(*h*), the program moves to step 330 to blank the ball position on display 14 and then to step 331 to store the possession in memory as at the catcher. From step 331, the program moves to step 332 to remove the indication in memory that a pitch is in progress and then moves to step 333 where a determination is made as to whether one of the hitting keys "C, O, or E E" was depressed indicating that the batter swung at the pitch. If none of these keys was depressed, the program moves to step 334 to determine whether the pitch was a ball or strike as recorded previously at step 285 shown in FIG. 4(*e*).

If the pitch was a ball and the batter has not swung at the ball, the program moves to step 335 to cause the speaker 144 to play a sound indicating that a ball has occurred, to step 336 to increment the number of balls called on this batter, and to step 337 to determine if four balls have been called on the batter. If four balls have been called on the batter, the program moves to step 338 to store an indication that no fielder possesses the ball and that a walk is in progress. The program then moves to step 339 to turn the batter into a runner.

From step 339 and from step 337 if less than four balls have been called on a batter, the program moves to step 340 to determine whether the game is in the one or two player mode. If a two player game is being played, the program moves to step 211 shown in FIG. 4(*a*) to continue through the swinging sequence.

If the one player game is being played at step 340, the program moves to step 341 to determine whether the ball is possessed or not. If the ball is possessed, the program moves to step 211 and continues the swing in process subroutine. If the ball is not possessed, the program moves to step 342 and causes the ball to be thrown to the pitcher under the control of control circuit 130. The program then moves to step 211 shown in FIG. 4(*a*) to continue the swing subroutine.

If at step 333 the batter has swung at the pitch or at step 334 the pitch was a strike, the program moves to step 350 to cause the speaker 144 to play a strike sound and then to step 351 to increment the number of strikes called on the batter. From step 351, the program moves to step 352 to determine whether three strikes have been called on the batter. If three strikes have not been called on the batter, the program moves to step 340 and continues as explained above.

If three strikes have been called on the batter at step 352, the program moves to step 353 to cause the next batter to come to bat and to step 354 to register an out in memory. From step 354 the program moves to step 340 and continues as explained above.

A preferred embodiment of a subroutine for step 211 shown in FIG. 4(*a*) is illustrated in FIG. 4(*i*). The subroutine is entered in step 360 at which a determination is made as to whether the operator controlling the team at bat has pressed one of the hit keys "C, O, or E." If the operator has not depressed one of these keys, the program moves to the roster input step 212 shown in FIG. 4(*a*). If the operator has pressed one of the keys "C, O, or E," the program moves to step 361 to decrement a swing counter. Like the pitcher counter and the ball counter previously explained, the swing counter is utilized to determine the amount of time each of the batter positions remains lit during the swing sequence.

From step 361, the program moves to step 362 to determine whether the swing counter has been decremented to zero so that it is time to move to the next batter position in the sequence. If the swing counter has not been decremented to zero, the program returns to step 212 shown in FIG. 4(*a*).

If the swing counter has been decremented to zero at step 362, the program moves to step 363 to reset the swing counter and to step 364 at which a determination is made as to whether the batter is in the first position of the swing routine. As a matter of detail, the sequence includes a number of particular batter positions commencing with zero as the first position. If the batter is in the first position at step 364, the program moves to step 365 to increment the position by one and then exits the subroutine and moves to step 212 shown in FIG. 4(*a*).

If at step 364 the batter has passed the first position, the program moves to step 367 to determine whether the key "C" has been depressed indicating that a bunt swing is desired. If a bunt swing is indicated, the program moves to step 368 to cause the batter to swing to the bunt position (position six) on display 14 and then moves to step 212 shown in FIG. 4(*a*). If a bunt swing is not indicated at step 367, the program moves to step 370 to determine whether the batter is in one of the intermediate positions in the normal hit sequence. If the batter is in one of the intermediate positions of the normal hit sequence, the program moves to step 365 and increments the position by one and then moves to step 212 shown in FIG. 4(*a*). If the batter is not in one of the first intermediate positions of the hit sequence, the program moves directly to step 212.

FIG. 4(*j*) shows a preferred embodiment of a flow chart for implementing the subroutine of step 212 shown in FIG. 4(*a*) in which each operator selects (or makes substitutions in) his roster in the memory of the control circuitry. The subroutine is entered at step 380 at which a determination is made as to whether it is the correct point in the routine for providing roster inputs. If it is not the correct time at step 380, the program moves to step 214 shown in FIG. 4(*a*) and exits the subroutine. If it is the correct input time at step 380, the program moves to step 381 to cause a random number to be generated and to step 382 at which a determination is made as to whether it is yet the particular step in the roster input subroutine at which the game speed is furnished. If it is time for the game speed to be selected at step 382, the program moves to step 383 to cause the digit indicators 22 and 24 to exhibit the letters "LV" indicating that game speed is to be inserted by the operator. The program then moves to step 384.

If it is not that time in the roster input subroutine for the game speed to be furnished, the program moves from step 382 to step 386 to determine whether a batter number or a position is being furnished. If a batter number is being furnished, the program moves to step 387 to cause the digit 22 to display a "B" and the digit 24 to display the lineup number of the player which has been selected. The program then moves to step 384. If a position number is to be provided at step 386, the program moves to step 388 to cause the letters "PN" to be displayed by digits 22 and 24 and then moves to step 384.

At step 384, the program inquires whether a number has been furnished to the control circuitry by the operator controlling the particular input. If a number has not been furnished to indicate the game speed, the batter, or the batter's position, the program moves to step 214 shown in FIG. 4(*a*) and continues with the running subroutine. If a key has been depressed to indicate either a speed of game play, a batter number, or a batter position, the program moves from step 384 to step 385 to determine whether the number furnished is less than or equal to ten. If the number furnished is less than ten or equal to ten, the program moves to step 386. If the number is greater than ten, the program moves to step 387.

If at step 387 the number entered is eleven or less, the program moves to step 388. If the number is greater than eleven, the program moves to step 389 to blank out digits 26 and 28 on the display and to step 390 to reset the input register to zero. From step 390, the program returns to step 214 shown in FIG. 4(*a*).

If at step 385, shown in FIG. 4(*j*), the number furnished is greater than ten and is determined at step 387 to be greater than eleven, the only number which could have been pushed is the key "C" for clear. This causes the program to move to steps 389 and 390 to accomplish the clearing. However, if at step 387 the number is determined to be eleven indicating the enter key has been depressed (key E), the program moves to step 388 to cause a number previously provided by the operator or the standard roster stored in memory to be entered in the roster.

If at step 385 is is determined that a number ten or less has been provided by the operator, this number must be an indication of a game speed, a batter number or a position number and the program moves to step 386. A subroutine for step 386 is shown in FIG. 4(*k*) which is entered at step 392 at which it is determined whether the number entered is nine or less. If the number is not less than nine, the number must be ten and the program moves to step 393 to reset the input register. From step 393 and from step 392 if the number is nine or less, the program moves to step 394 to play the sound for the particular digit, to step 395 to cause the digit formerly in the lower right digit 28 to be moved to the lower left digit 26, and to step 396 to cause the lower right digit 28 to display the number provided by the operator. From step 396 the program moves to zero the input register at step 397 and then to step 214 shown in FIG. 4(*a*).

A subroutine for implementing step 386 of FIG. 4(*j*) is shown in FIG. 4(*l*). The subroutine is used in the preferred embodiment of the game 10 for entering the roster or substituting players. The subroutine is entered at step 400 at which it is determined whether the lower right-hand digit indicator 28 is blank. If the indicator 28 is blank, this means that a player is not being entered in an original roster but that the standard lineup may be being entered. If so, the program moves to step 401 to determine whether the point in the routine is such that a batter number or a position would be entered. It will be recalled that simply by depressing enter key "E" when it is time for the first batter to be entered, the standard lineup is entered. Thus, if it is time for a position to be entered at step 401, the program moves to step 389 shown in FIG. 4(*j*) to implement the clear procedure because an error has occurred. If at step 401 the time is that in which batter would be entered, the program moves to step 402 to determine whether a substitution or an original roster lineup is being entered. If a substitution is being made, the program moves to step 403 to indicate that the input is over. If the time in the sequence is that for an original input of roster, the program moves to step 404 to determine whether it is time for the first batter in the batting order to be inserted. If not, the program moves to step 389 to clear the entry as an error. If it is time for the first batter, the program moves to step 405 to set the batting order at the last man thereby skipping all the steps required in the normal insertion of players into the batting order. From step 405, the program moves to step 406 to store the standard roster as the lineup in the RAM memory of the control circuit 130. From step 406, the program moves to step 407.

If at step 400 a number is shown in the lower right digit indicator 28, then a batter number, a batter position, or a speed of play is being entered; and the program moves to step 410. At step 410 it is determined whether the lower left digit indicator 26 is blank. If the indicator 26 is not blank, the program moves to step 411 to determine whether the lower left digit 26 is zero. If the digit is zero, the program moves to step 412. If the digit is not zero, the program moves to step 413 to determine whether the left digit is one. If the left digit is not zero or one, the digit is in error and the program moves to step 389 shown in FIG. 4(*j*) to implement the clear process. If the digit is one at step 413, the program moves to step 414 to cause the number to be entered into memory to be the right digit 28 plus ten. The program then cycles to step 412.

The program also reaches step 412 from step 410 if the lower left digit 26 is blank. At step 412 it is determined whether the number entered is zero. If the number is zero, the entry is incorrect, and the program moves to step 389 to implement the clear process. If the entry number is not zero, the program moves to step 416 to determine whether the step of the sequence during which players are entered on the roster is nine or less. If the step is nine or less, the program moves to step 417. If the step is not nine or less, so that it is time for a game speed to be entered, the program moves to step 418 to determine if the number entered is four or less. If the number is not four or less, the program moves to step 389 to implement the clear process. If the number entered is four or less at step 418, the program moves to step 419 to store the game speed and then moves to step 407.

A subroutine for accomplishing the roster entry step 417 shown in FIG. 4(*l*) in the preferred embodiment is illustrated in FIG. 4(i m). The subroutine is entered at step 425 at which it is determined whether the player number or the position number is being entered. If the position number is being entered, the program moves to step 426 at which it is determined whether the number entered is nine or less. If the number is not nine or less, the entry is in error; and the program moves to step 389 to implement the clear process.

If at step 426 the number entered is nine or less, the program moves to step 427 where it is determined whether the entry has already been made; that is, a player cannot be entered once his number has already been used, and a player cannot be entered in a position which is already occupied. The program also moves to step 427 from step 425 if a player number is being entered. If the player or position number has already been entered, the program moves to step 389 to implement the clear process for an incorrect entry. If the player or position has not already been entered at step 427, the program moves to step 428 to store the entry and to step 429 where it is determined whether a batter number or a position number is being entered. If a position number is being entered at step 429, the program moves to step 430 to determine if that position is the pitcher position. If not, the program moves to step 407. If at step 430 a pitcher position is being entered, the program moves to step 431 to store the strength factor for that pitcher in the RAM of the control circuit and then moves to step 407.

If at step 429 a player number is being entered, the program moves to step 435 to determine whether the player being entered is is a new pitcher. If the player is not a new pitcher, the program moves to step 436 to store the number of the player being replaced in memory as having been removed and then moves to step 407. If a new pitcher is being selected at step 435, the program moves to step 437 to determine the pitcher's strength factor from memory and to step 438 to store that strength factor. From step 438, the program moves to step 436 to store in memory the number of the player removed from the game and then to step 407.

FIG. 4(*n*) illustrates a preferred embodiment of a flow chart for implementing step 407 shown in FIGS. 4(*l*) and 4(*m*). The program is entered at step 440 at which an enter sound is emitted by the speaker 144. The program then moves to step 441 at which a determination is made whether the step in the entry of roster has been reached at which the speed of play is to be entered. If this step has not yet been reached, the program moves to step 442 to determine whether a substitution is taking place as would be determined by depression of the key "1" or "3" after the roster has already been entered and play is taking place.

If a substitution is to occur, the program moves to step 403 and then to step 443 to store in RAM memory of the control circuit 130 the player who is at bat. If a substitution is not being made, the program moves to step 445 to determine whether the player number or the player position is being entered. If the player number is being entered, the program moves to step 446 to set the control circuitry to enter the player position as the next step and then moves to step 389 to institute the clear routine.

If a position is being entered at step 445, the program moves to step 447 to cause the control circuitry to provide that the next step will be to enter a player number. The program then moves to step 448. The program moves to step 448 as well from step 441 if the stage of the roster entry procedure is such that it is time for the speed of play to be entered. At step 448 the stage of entry is incremented by one, and the program moves to step 449 at which an inquiry is made as to whether the roster entry for the particular team has been completed. If not, the program moves to step 389 to implement the clear process.

If the entry for that team has been completed, the program moves to step 452 to reset the roster entry state to the beginning and to step 453 at which it is determined whether the entry which has just been completed is of the visitor or the home team. If the visitor team has just been entered, the program moves to step 454 to cause the next step to occur to be the entry of the home team. If the home team has just been entered, the program moves to step 443 to store an indication of the last entry in the RAM of the control circuitry and to step 455 to store an indication that the roster entry procedure is completed. The program then moves to step 456 to set the state of the digit indicators 22, 24, 26, and 28 to zero. From each of steps 454 and 456 the program moves to step 389 to institute the clear process.

It should be noted that after step 403 shown in FIG. 4(*l*) is implemented, the program continues by proceeding to step 443 shown in FIG. 4(*n*) and then proceeding through steps 455 and 456 as explained above.

FIG. 4(*o*) illustrates a subroutine used in the preferred embodiment of the invention for accomplishing the details of the running subroutine of step 214 shown in FIG. 4(*a*). The subroutine begins at step 470 at which the control circuitry determines the position of the most advanced runner on the base paths. As pointed out above, there are fifteen distinct positions for base runners shown on display 14 starting with position 31 and moving around to position 45. Position 31 is designated the first position, position 32 the second position, and so on. The program moves from step 470 to step 471 at which it is determined if the lead runner is in position 31, position 32, or position 33. If the lead runner is in any of these three positions, the program moves to step 472 where the run forward subroutine is implemented.

If the lead runner is not in position 31, 32, or 33 at step 471, the program moves to step 474 to determine whether the run forward key "6" on the offensive operator's keyboard has been depressed. If the key "6" has been depressed, the program moves to step 475 to determine whether the runners on the base paths are frozen in position (cannot move forward). The runners are frozen in position by the control circuitry on foul balls and fly outs and each must return to the last base. Consequently, the program moves from step 475 when the runners are frozen to step 215 to implement the hitting sequence. If the runners are not frozen, the program moves from step 475 to step 472 to implement the subroutine for running forward.

If at step 474 the run forward key "6" has not been depressed, the program moves to step 480 to determine whether the run backward key "4" has been depressed. If the run backward key "4" has been depressed, the program moves to step 481 to store an indication in memory that the last direction pressed is backwards and to step 482 to decrement a run timer used for determining the time a runner remains at each of the positions. From step 482, the program moves to step 483 to determine whether the run timer has reached zero. If the run timer has reached zero, the program moves to step 484 to determine whether the position to which the runner has advanced is home base. If the position is not home base at step 484, the program moves to step 485 to determine whether the last position is equal to the base last left by the runner. A runner cannot run backwards past a base; and, consequently, the program must exit the routine when the runner reaches the last base touched.

If at step 485 the runner has not reached the base last occupied, the program moves to step 486 to determine whether the runner is attempting to occupy a position already occupied by another runner. If so, the runner cannot occupy this position. If the runner is not attempting to occupy the position occupied by another runner, the program moves to step 487 to cause the runner to occupy the new position. The program then moves to step 490 to deal with the next runner. The program also moves to step 490 from step 486 if the runner is attempting to occupy a position which is already occupied, from step 485 if the runner is attempting to pass a base in the reverse direction, from step 484 if the runner has reached home base, and from step 483 if it is not yet time to change positions.

At step 490, a determination is made whether all runners have been attended to. If so, the program moves to step 215 to implement the hitting subroutine. If not, the program moves to step 491 to determine whether the next runner is in a position equal to or less than position 33. If the position of the next runner is 31, 32, or 33, the program moves to step 472 to implement the run forward routine. If not, the program moves to step 492 to determine in which direction the runner was last directed to run. If forward, the program moves to step 475 and continues as explained above. If at step 492 the direction is backward, the program moves to step 480 and proceeds as explained. This arrangement allows a runner to be positioned off base (take a lead) by pushing the forward key "6" and releasing it and then tapping once the backward key "4". As the program steps through the subroutine of FIG. 4(*o*) and reaches step 492, a determination is made that the runner has last been directed backwards. However, at step 480 it is found that the run backwards key "4" is no longer depressed. This causes the program to move to step 490 to investigate the next runner and, in effect, stops each runner in the leadoff position off base.

FIG. 4(*p*) is a flow chart of a preferred embodiment of a subroutine for implementing the run forward step 472 of FIG. 4(*o*). The subroutine is entered at step 500 at which an indication is stored that the last direction selected for runners to run was forward. The program then moves to step 501 to decrement the timer used to determine the period it takes for a runner to run from one position to an adjacent position. From step 501 the program moves to step 502 to determine whether the timer has counted to zero. If the timer has not counted to zero, the program moves to step 490 shown in FIG. 4(*o*) and proceeds as explained.

If the timer has counted to zero, the program moves to step 504 and determines whether the new position reached by the runner is home. If the new position is home base, the program moves to step 505 to increment the score and then to step 490 shown in FIG. 4(*o*). If the new position is not home base, the program moves to step 506 to determine whether the runner is attempting to enter a position which is already occupied by a runner. If so, the program moves to step 490 shown in FIG. 4(*o*). If not, the program moves from step 506 to step 508 to determine whether there is a runner on the next base. If there is a runner before or on the next base, this runner must stop at the base he is on; and the program moves to step 490 and proceeds to move the next runner. If there is no runner on the next base, the program moves from step 508 to step 509 to cause the runner to take the new position and then moves to step 490 shown in FIG. 4(*o*).

FIG. 4(*q*) illustrates a subroutine for accomplishing the details of the hitting step 215 illustrated in FIG. 4(*a*). The subroutine is entered at step 515 at which it is determined whether the batter has yet attempted to hit the ball on this pitch. If the batter has attempted a hit this pitch, the program moves to step 216 shown in FIG. 4(*a*) and exits the subroutine. If the batter has not yet tried to hit the pitch, the program moves to step 516 to determine whether the ball is in a position over the plate in which it may be hit. If not, the program moves to step 216.

If the ball is in a position to be hit at step 516, the program moves to step 517 to store an indication that a hit has been attempted. The program then moves to step 518 to determine whether the batter is attempting a bunt. If the batter is attempting a bunt, the program moves to step 519 to select a random number between zero and fifteen and to compare that random number with eight. If the number is less than eight (in half of the cases), the program finds that the batter has missed the pitch and moves to step 216 to implement the catch subroutine.

If the random numer is eight or greater, the program moves to step 520 to indicate that a bunt had been hit and then to step 521.

If at step 518 a bunt has not been attempted, the program moves to step 523 to determine whether the batter is in that position of the hit sequence at which the ball and bat meet. If the batter is not in this position, the program moves to step 216 to implement the catch subroutine. If the batter is in this position, the program moves to step 525 to select a second random number between zero and fifteen and to determine whether that number is equal to fifteen. If the random number is not equal to fifteen, the program moves to step 526. If the random number selected is fifteen (in one out of sixteen cases), the program moves to step 528.

At step 528 a new random number between zero and fifteen is generated and a determination is made whether this random number is less than or equal to the batter's home run rating. In the preferred embodiment of the invention, a batter's home run rating is selected to be a number from zero to three. Consequently, a batter with a home run rating of three has four changes out of sixteen that his home run rating will be equal to or greater than the random number generated while a batter whose home run rating is zero has one chance out of sixteen that his home run rating will be equal to the random number generated. If a batter's home run rating is equal to or greater than the random number selected at step 528, the program moves to step 529 to cause a home run to be hit and then moves to step 521. If the random number selected at step 528 is greater than the hitter's home run rating, the program moves to step 526.

FIG. 4(*r*) illustrates a flow chart for a preferred embodiment of a subroutine for accomplishing step 526 shown in FIG. 4(*q*). The subroutine begins at step 531 at which a pitcher's strength is decremented by one. Since this point in the routine is reached through the subroutine shown in FIG. 4(*q*) at which a hit is attempted other than through the paths for bunts or home runs, the pitcher's strength is decremented with every swing of the bat in which the ball is contacted other than bunts or home runs.

The pitcher's strength is selected as a number between zero and fifteen so that after fifteen times in which the ball has been contacted by the bat that strength will be decremented to zero. From step 531, the program moves to step 532 to determine whether the pitcher's strength has yet been decremented to zero. If not, the program moves to step 533 to set the average to be used in determining whether a hit occurs other than a bunt or home run to be equal to the pitcher's average. Once again the pitcher's averages are selected to vary between zero and fifteen with the lower numbers being more advantageous from a pitcher's standpoint.

If at step 532 the pitcher's strength has been decremented to zero, the program moves to step 534 to set the average to be equal to the batter's average which is shown in Table I. This is stored in memory as a number such as that shown in Table III which follows. From either of steps 533 or 534, the program moves to step 535.

Thus, it may be seen that until the pitcher's strength has been decremented to zero, the pitcher's average controls whether a batter obtains a hit or not while after the pitcher's strength has been decremented to zero, the batter's average controls whether the batter obtains a hit or not.

At step 535 it is determined whether a batter has attempted a home run swing (the operator depressed the key "E"). If so, the program moves to step 537 to subtract one from the average to be used to that point. From step 537 and from step 535, if a home run swing has not been taken, the program moves to step 538 where it is determined whether the pitcher and batter pitch and bat, respectively, on opposite sides (e.g., right handed versus left handed). If the pitcher pitches and the batter bats on opposite sides, the program moves to step 539 to increase the average to be used by one.

From step 539 and from step 538 if the pitcher and batter are not opposite, the program moves to step 541 to determine whether a runner is on base. If a runner is on base, the program moves to step 542 to increase the average by the RBI rating of the batter. The RBI rating of the batter is a number from zero to three with the higher number indicating a batter who obtains more hits with runners on base.

From step 542 and from step 541 if no one is on base, the program moves to step 544 to generate a random number and determine whether that random number is less than or equal to the average generated in the last few steps of the program. If the number is less than or equal to the average, the program moves to step 545 to indicate a hit. If the random number is greater than average, the program moves from step 544 to step 546 to provide that the ball although contacted is not a hit.

From step 545 the program moves to step 547 to select a random number from one to fourteen. This number selected provides the type of hit there being in the preferred embodiment a triple to center field, a double to left field, a double to right field, three singles to left field, three singles to right field, three singles to center field, and two Texas league hits. From step 546 the program moves to step 543 to select a random number between zero and fifteen. This number is used to select from two foul balls, nine fly balls, and five grounders, all of which are not hits.

From steps 547 and 543 the program moves to step 548 to determine whether a foul ball has been hit. If a foul ball has not been hit, the program moves to step 549 at which the batter becomes a runner. From step 549 the program moves to step 212 shown in FIG. 4(*a*) to implement the input subroutine. If at step 548 a foul ball has been hit, the program moves to step 550 to freeze the runners and then moves to step 212 to exit the subroutine.

When it is found that a home run has been hit at step 529 or a bunt has been hit at step 520 shown in FIG. 4(*q*), the program moves to step 521. Step 521 is implemented in the preferred embodiment by that portion of the subroutine shown in FIG. 4(*r*) which commences with step 548. The program then continues through step 549 and exits to step 212.

FIG. 4(*s*) illustrates a subroutine which in the preferred embodiment accomplishes the details of step 549 shown in FIG. 4(*r*). The subroutine is entered at step 560 at which the position of batter becoming a runner is indicated to be the first position (that is, position thirty-one illustrated in FIG. 2). From step 560 the program moves to step 561 to set a run timer to have an overall period between runner positions equal to six plus the speed rating for the runner. The speed rating for the runner in the preferred embodiment is a number between zero and three so that a runner having a speed rating of zero has the run timer set at the least time equivalent to an interval of six while a runner having a speed rating of three has his run time between positions set at a greater time of nine counts.

From step 561 the program moves to step 563 to blank the batter position 30, to step 564 to reset the ball and strike count on display 14 to zero, and to step 565 to reset the number of the man at bat to be the next player on the roster. The program then moves to step 567 to determine whether the man at bat is the tenth man in the batting order. If so, the program moves to step 568 to reset the order so that the first batter appears next. From step 568 and from step 567 if the batter is not the tenth man on the roster, the program moves to step 569 to store the roster number of the new batter in the "at bat" portion of the RAM of the control circuitry and then exits the subroutine to return to step 380.

FIG. 4(*t*) illustrates a subroutine used in the preferred embodiment of the invention for implementing the catch step 216 shown in FIG. 4(*a*). The subroutine is entered at step 575 where a determination is made whether there is a throw in progress. If not, the program exits the subroutine and moves to step 217 illustrated in FIG. 4(*a*). If at step 575 a throw is in progress, the program moves to step 576 to decrement a throw timer. It will be recalled that in the subroutine shown in FIG. 4(*d*), the throw timer was initialized to different settings depending on whether the throw was from an outfielder or an infielder with a slower count being provided for a throw from an outfielder.

From step 576, the program moves to step 577 to determine whether the throw timer has been decremented to zero. If not, the program exits the subroutine and moves to the hit ball subroutine shown in step 217 of FIG. 4(*a*). If the timer has been decremented to zero at step 577, the program moves to step 579 to set the possession of the ball as being at the position of the player to whom the ball was thrown (selected by depressing a key 2, 4, 5, 6, or 8 on the defensive operator's keyboard). From step 579, the program moves to step 580 to determine whether the possession is in the pitcher. If the pitcher does not have the ball, the program moves to step 581 to play the catch sound and exits the subroutine to return to step 217 shown in FIG. 4(*a*).

If the pitcher possesses the ball at step 580, the program moves to step 582 to reset the pitching sequence, the hit sequence, the swing state, the type of pitch and the indications that a hit has occurred, all stored in the RAM. From step 582, the program moves to step 581 to cause a catch sound to be produced by the speaker 144 and then moves to step 217 shown in FIG. 4(*a*).

FIG. 4(*u*) illustrates a flow chart which may be used in the preferred embodiment of the invention for implementing the hit ball path routine of step 217 shown in FIG. 4(*a*). The subroutine is entered at step 585 at which a determination is made whether a ball has been hit. If a ball has not been hit, the program exits the subroutine and moves to step 218 shown in FIG. 4(*a*). If at step 585 it is found that a ball has been hit, the program moves to step 586 to decrement a ball counter which provides a standard time between ball positions. From step 586, the program moves to step 587 to determine if the ball counter has counted to zero. If not, the program exits the subroutine and proceeds to step 218 shown in FIG. 4(*a*).

If at step 587 the ball counter has counted to zero, the program moves to step 589 to reinitialize the ball counter and to step 590 at which a determination is made whether the time of the hit should be increased for any reason. For example, fly balls take longer than grounders. Popups, triples, and doubles take longer than a standard grounder. If the time is to be lengthened, the program moves to step 598 to decrement the wait time and then moves to step 218 shown in FIG. 4(*a*). If the time should not be lengthened, the program moves to step 591 to move to the next position in the particular ball sequence and to step 592 to determine the next ball position from a lookup table stored in the ROM of the control circuitry.

The program then moves to step 594 at which a portion of the number indicating the ball path found in the lookup table is reviewed to determine whether the ball should be lit in the particular position. As was pointed out above, certain hits will proceed out of the screen toward the top and will reappear on the screen at some other point indicating that they have been hit up in the air and fallen back to the field. When the ball has left the screen, no light is provided until it returns. If at step 594 the number selected is found to be five or less, the program moves to step 595 to store the number in the RAM of the control circuit and to step 596 to determine if a home run has been hit. If a home run has not been hit, the program moves to step 218 shown in FIG. 4(*a*). If a home run has been hit, the program moves to step 597 to reinitiate the ball counter to provide a faster speed of travel. The program then moves to step 218 shown in FIG. 4(*a*).

If at step 594 the number selected is over five, the program moves to step 600 shown in FIG. 4(*v*) 1 where it is determined whether the number selected is equal to six. If the number is equal to six, an extension of the ball count (a lengthening of the time the the ball is in the air) is provided and the program moves to step 601 to provide such an extension from the number found in the lookup table. If at step 600 the number is not six, the program moves to step 602 to determine whether the number selected is seven. If the number is seven, the program moves to step 603 to blank the ball (turn off the ball light to indicate a ball which has gone above the display 14) and then to step 601 to extend the ball time by the selected amount from the lookup table.

From step 601 the program moves to step 604 to select a random number between zero and fifteen and to determine whether that number is less than eight. If the number is less than eight, the program moves to step 605 where it extends the length of the ball time by one count. If the number is eight or greater, the program moves to step 606 to decrease the length of the ball time by one count. From steps 605 and 606 the program moves to step 218 shown in FIG. 4(*a*).

The sequence through steps 594, 600, 602, 603, and 601 thus determines the wait time for each particular hit. As the program recycles through the subroutine and reaches step 590, the wait time is decremented with each cycle until no wait time is left.

If at step 602 the number selected is not seven, the program moves to step 610 to determine which fielder possesses the ball at the end of the hit as shown by the number found from the lookup table at step 592. The program then moves to step 611 to blank the light of the ball position and to step 612 to determine whether the game is in the one player mode. If the game is not in the one player mode, the program moves to step 613. If the game is in the one player mode, the program moves to step 614 to determine whether the ball is out of the hands of the defensive players. If the ball is not in the hands of a defensive player, the program moves to step 613. If the ball is possessed by one of the defensive players, the program moves to step 615 and causes a throw to be made to the pitcher since all throws from the outfielders are automatically made to the pitcher in the one player mode. From step 615 the program moves to step 613.

At step 613 (see FIG. 4(*v*)2), it is determined by the number from the lookup table whether the hit is one which drops in the field and then is picked up by a fielder. If so, the program moves to step 616 at which a catch sound is played by the speaker 144. If the ball is not one which drops in the field to be picked up by a fielder, the program moves to step 617 to determine whether the batter is out on a fly ball and as determined from the lookup table. If so, the program moves to step 618 to indicate the batter has been called out and to step 619 to put the runners back on the bases they occupied before the last pitch.

If at step 617 the batter was not out on a fly ball, the program moves to step 620 to determine whether a home run was hit. If a home run was hit, the program exits the subroutine and proceeds to step 218 shown in FIG. 4(*a*). If a home run was not hit, the program moves to step 622 to determine whether there are two strikes on the batter. If there are not yet two strikes on the batter, the program moves to step 623 to increment the number of strikes by one and then to step 617 to put the runners back on the bases they were on before the pitch. If there were two strikes on the batter at step 622, the program moves directly to step 619. It should be noted that the subroutine from step 622 is also followed when a foul ball is hit. From step 619 the program moves to step 616 to play a catch sound and then to step 218 shown in FIG. 4(*a*).

FIG. 4(*w*) is a flow chart illustrating a subroutine which may be used in the preferred embodiment of the invention for implementing step 218 shown in FIG. 4(*a*). The subroutine is entered at step 625 at which it is determined whether the ball is held by the catcher, first baseman, second baseman, or third baseman. If not, the program moves to step 219 shown in FIG. 4(*a*). If the catcher, first baseman, second baseman, or third baseman has the ball, the program moves to step 626 at which the position of a runner is determined. The program then moves to step 627 to determine whether the positions of all runners have been checked. If so, the program moves to step 219 shown in FIG. 4(*a*).

If all runners have not been checked, the program moves to step 628 to determine whether the runner being checked is off base and has not yet reached the base where the fielder has the ball. If the runner is off base, the program moves to step 630 to determine whether the runner has been forced to run as where the runner is on first base and the batter has just gotten a hit. If the runner has been forced to run and the ball is at the base immediately ahead of the runner, the program moves to step 631 and the runner is called out. If the runner is not forced to run or if the runner is at the base, the program moves from either step 630 or step 628 to step 632 where it is determined whether the runner is in a position one player position ahead of the base where the fielder holds the ball. If so, the program moves to step 631 and the runner is called out. If at step 632 the runner is not one player position ahead of the base being investigated, the program moves to step 633 to determine whether the runner is in a position one position behind the base in question. If so, the program moves to step 631 and the runner is called out. From step 631, the program exits the subroutine and moves to step 219 shown in FIG. 4(*a*).

If at step 633 the runner is not at a position just before the base, the program moves to step 635 where it is determined whether the runner is in the player position two in front of the base of interest (i.e., the player position midway between the base of interest and the last base touched by the runner). If the runner is not in this position, the program moves from step 635 to step 626 and investigates another runner and then proceeds as explained above.

If at step 635 the runner is in the position midway between bases (two player positions immediately in front of the base of interest), the program moves to step 636 to select a random number between zero and fifteen and determines whether that number is fifteen. If the number is not fifteen, the program moves from step 636 to step 626 to investigate another runner. If the random number selected is fifteen (in one out of sixteen cases), the program moves to step 637 to select another random number between zero and fifteen and to determine whether that random number is fifteen. If the random number selected at step 637 is not fifteen, the program proceeds to step 626 to find another runner to investigate. If the random number is fifteen at step 637, the program moves to step 631 to call the runner out and exits the subroutine shown in FIG. 4(*a*).

Steps 636 and 637 provide that in one out of two hundred and fifty-six cases the runner in the middle position between bases will be called out when the fielder on the base ahead receives the ball. Using this set of odds, the program must run through a number of iterations before a runner in a middle position between bases will be called out in the usual case. This furnishes a random time for an operator controlling a runner in a middle position to return that runner to the next preceding base and avoid a tag.

FIG. 4(*x*) illustrates a flow chart for a subroutine which may be used in the preferred embodiment of the invention to implement the details of step 219 illustrated in FIG. 4(*a*). The subroutine is entered at step 640 where a determination is made as to whether a home run has been hit. If a home run has been hit, the program moves to step 641 to determine whether there are any runners presently on base. If runners are on base, the program moves to step 220 shown in FIG. 4(*a*). If there are no runners on base at step 641, the program moves to step 642 to eliminate the home run indication in the RAM of the control circuitry and to cause the ball to be thrown to the pitcher.

If at step 640 a home run has not been hit, the program moves to step 645 to determine whether a walk has been given. If no walk has been given, the program moves directly to step 220 shown in FIG. 4(*a*). If at step 645 a walk has been given, the program moves to step 646 to determine whether any runners are forced to run because of the walk. If so, the program moves directly to step 220 shown in FIG. 4(*a*). If runners are not forced to run by the walk at step 646, the program moves to step 647 to eliminate the walk indication stored in the RAM of the control circuitry and then proceeds to step 642 to cause the ball to be thrown to the pitcher.

FIG. 4(*y*) illustrates a flow chart for implementing in the preferred embodiment of the invention the details of step 220 shown in FIG. 4(*a*). The subroutine is entered at step 650 at which a determination is made whether the game is in the one or two player mode. If the game is in the two player mode, the program moves directly to step 208 shown in FIG. 4(*a*). If the game is in the one player mode, the program moves to step 651 to determine whether the pitcher has the ball. If the pitcher does not have the ball, the program moves directly to step 208 shown in FIG. 4(*a*). If the pitcher has the ball at step 651, the program moves to step 652 to look for a runner on the base paths.

From step 652, the program moves to step 653 to determine whether all runners have been checked. Once all runners have been checked, the program moves directly to step 208. If all runners have not been checked at step 653, th program moves to step 654 to determine whether the runner is on a base. If the runner is on a base, the program moves back and recycles to step 652 and proceeds as explained above to check the remaining runners. If the runner is not on a base, the program moves to step 655 where the runner is called out. From step 655 the program moves to step 208 shown in FIG. 4(*a*).

Thus, in the one player game, when the pitcher receives the ball and a runner is off base, that runner is called out.

FIG. 4(*z*) is a flow chart for a subroutine which may be used to perform the details of step 655 illustrated in FIG. 4(*y*). The subroutine is entered at step 660 in which a counter for timing the on-time of the "OUT" indication is initialized. The program then moves to step 661 to increment the number of outs by one. From step 661, the program moves to step 662 where a determination is made whether there are yet three outs. If there are not three outs, the program moves to step 208 shown in FIG. 4(*a*) and recycles.

If there are three outs at step 662, the program moves to step 664 to reset the outs indication to zero and to step 665 to remove all runners from base paths. The program then moves to step 666 to determine whether any runs have been scored during this inning. If so, the program moves to step 667 to cause the speaker to play the "runs scored" sound. From step 667 and from step 666 if no runs have been scored during the inning, the program moves to step 668 to determine whether the visiting team is at bat.

If the visiting team is at bat, the program moves to step 669 to determine whether the game is in the one player mode. If the game is in the one player mode at step 669, the program moves to step 670 to increment the inning being played by one since only one team plays during an inning in the one player mode. If the visitors are at bat and the game is not in the one player mode at step 669, the program moves to step 671 to bring the home team to bat and then moves to step 672 to cause an end of inning sound to be played by speaker 144 an to step 673 to reset the balls and strikes count to zero. From step 673, the program returns to step 208 shown in FIG. 4(*a*) and recycles.

If at step 668 the home team is at bat, the program moves to step 675 to bring the visiting team to bat and to step 670 to increment the inning by one. From step 670, the program proceeds to step 680 where a determination is made whether it is the tenth inning or not. If it is not the tenth inning, the program moves to step 672 and proceeds as explained above. If it is the tenth inning at step 680, the program moves to step 681 to store an indication that the game is over and then moves to step 672 and proceeds as explained above.

Table III which follows lists typical characteristics of players shown in Table I weighted in accordance with the foregoing disclosure.

TABLE III

| | | RBI | HR | Batting Average | Arm Strength | Run Speed Stolen | Bats | Throws | Strength Factor | Pitching Average | Probability of Strikes |
|---|---|---|---|---|---|---|---|---|---|---|---|
| SS | 1 | 0 | 0 | 9 | 0 | 0 | R | R | 7 | 13 | 10 |
| Sub | 2 | 3 | 0 | 11 | 3 | 3 | L | R | 3 | 11 | 11 |
| LF | 3 | 0 | 3 | 8 | 1 | 2 | L | L | 3 | 11 | 10 |
| 2B | 4 | 2 | 1 | 7 | 2 | 1 | R | R | 12 | 11 | 5 |
| Sub | 5 | 0 | 1 | 6 | 1 | 3 | R | R | 9 | 7 | 6 |
| C | 6 | 3 | 1 | 9 | 1 | 2 | R | R | 8 | 7 | 9 |
| STM | 7 | 1 | 2 | 9 | 2 | 1 | R | R | 12 | 6 | 8 |
| CF | 8 | 0 | 0 | 8 | 0 | 0 | R | L | 7 | 8 | 8 |
| RF | 9 | 3 | 3 | 7 | 3 | 3 | L | L | 1 | 10 | 12 |
| 1B | 10 | 1 | 2 | 7 | 3 | 2 | L | L | 3 | 11 | 15 |
| 3b | 11 | 1 | 3 | 10 | 0 | 2 | R | R | 12 | 3 | 6 |
| P | 12 | 1 | 0 | 1 | 0 | 3 | L | L | 14 | 5 | 6 |
| P | 13 | 0 | 0 | 1 | 0 | 3 | R | R | 5 | 5 | 2 |
| P | 14 | 0 | 0 | 3 | 2 | 2 | R | R | 15 | 6 | 7 |
| P | 15 | 3 | 2 | 7 | 1 | 1 | L | L | 7 | 6 | 5 |

As will be understood by those skilled in the art, many different programs may be utilized to implement the flow charts disclosed in this specification. Obviously, those programs will vary from one another in different degrees. However, it is well within the skill of the art of the computer programmer to provide particular programs for implementing each of the steps of the flow charts disclosed herein. It is also to be understood that various microcomputer circuits might be programmed for implementing each of the steps of the flow charts disclosed herein therefore to be understood that, because various other embodiments may be devised by those skilled in the art without departing from the spirit and scope of the invention, it is the intention of the inventors to be limited only by the scope of the claims appended hereto.

What is claimed is:

1. An electronic baseball game comprising a display having indicia representing a ball, a pitcher pitching the ball, and a batter swinging a bat; first input means responsive to operator control for assigning predetermined pitcher characteristics and for causing the pitcher to pitch the ball; second input means responsive to operator control for causing the batter to swing at the ball; and control means responsive to the first and second input means and including means for controlling the display indicia to simulate pitching, batting and movement of the ball, contact determining means for determining if the batter's swing causes the bat to contact the pitched ball, pitcher control means responsive to the contact determining means for altering one of the predetermined pitcher characteristics if the ball is contacted by the bat said characteristic including pitcher arm strength, and hit control means for determining the probability that the contacted ball is a successful hit as a function of the altered pitcher characteristic.

2. The game of claim 1 in which the pitcher control means alters one of the predetermined pitcher characteristics including pitcher arm strength in a manner which causes the hit control means to change the probability that the contacted ball is a successful hit after the ball has been contacted a predetermined number of times.

3. The game of claim 1 in which second input means further enables an operator to assign predetermined batter characteristics; and the hit control means determines the probability that the contacted ball is a successful hit as a function of a particular one of the predetermined batter characteristics when the altered pitcher characteristic reaches a predetermined value.

4. The game of claim 1 in which the display further includes indicia representing bases, basemen, base runners, and base runner positions including the bases, a position immediately preceding each base, and a middle position generally midway between adjacent bases; third input means responsive to operator control for causing the runners to run forward and for causing a particular runner to run backward if that runner is not on any base; fourth input means responsive to operator control for throwing the ball to any of the basemen; and in which the control means is responsive to the third and fourth input means and includes means for controlling the display indicia to simulate ball throwing, ball catching, and base runner movement, means for calling a particular runner out if that runner is on a position immediately preceding a base and if that baseman has possession of the ball, delay means for establishing a generally random delay time when a runner is on a middle position, and means responsive to the delay means for calling a particular runner out if that runner is on a middle position and the baseman following the middle position has possession of the ball and the random delay time has expired, whereby the operator may attempt to steal a base or to cause the particular runner to run back to the preceding base before the runner is called out.

5. The game of claim 4 in which the display further includes indicia representing a leadoff runner position immediately following each base; and the third input means further enables the operator to advance a runner to a leadoff position and to maintain the runner at that position.

* * * * *